US006156710A

United States Patent [19]

Sivik et al.

[11] Patent Number: 6,156,710

[45] **Date of Patent: *Dec. 5, 2000**

[54] RINSE ADDED FABRIC SOFTENING COMPOSITIONS AND METHOD OF USE FOR THE DELIVERY OF FRAGRANCE PRECURSORS

[75] Inventors: Mark Robert Sivik, Fairfield; John Cort Severns, West Chester; Frederick Anthony Hartman, Cincinnati; Jill Bonham Costa, Cincinnati; John Michael Gardlik, Cincinnati; Toan Trinh, Maineville; Scott William Waite, Cincinnati, all of Ohio

[73] Assignee: The Procter & Gamble Company, Cincinnati, Ohio

[ * ] Notice: This patent is subject to a terminal disclaimer.

[21] Appl. No.: 09/242,270

[22] PCT Filed: Aug. 6, 1997

[86] PCT No.: PCT/US97/13660

§ 371 Date: Mar. 24, 1999

§ 102(e) Date: Mar. 24, 1999

[87] PCT Pub. No.: WO98/06803

PCT Pub. Date: Feb. 19, 1998

Related U.S. Application Data

[60] Provisional application No. 60/023,786, Aug. 12, 1996.

[51] Int. Cl.[7] ..... C11D 3/20

[52] U.S. Cl. ..... 510/101; 510/521; 510/526

[58] Field of Search ..... 510/101, 521, 510/526

[56] References Cited

U.S. PATENT DOCUMENTS

| | | | |
|---|---|---|---|
| 3,932,520 | 1/1976 | Hoffmann | 260/594 |
| 4,315,952 | 2/1982 | Boden | 426/536 |
| 4,548,743 | 10/1985 | Sprecker et al. | 252/522 R |
| 4,614,611 | 9/1986 | Sprecker | 252/522 |
| 5,188,753 | 2/1993 | Schmidt et al. | 252/132 |
| 5,378,468 | 1/1995 | Suffis et al. | 424/401 |
| 5,500,138 | 3/1996 | Bacon et al. | 252/8.8 |
| 5,531,910 | 7/1996 | Severns et al. | 510/102 |
| 5,562,847 | 10/1996 | Waite et al. | 510/519 |

FOREIGN PATENT DOCUMENTS

| | | | |
|---|---|---|---|
| 0 278 020 | 8/1988 | European Pat. Off. | C07D 321/06 |
| XP002048918 | 9/1993 | Japan | A61K 7/46 |
| WO 94/06441 | 3/1994 | WIPO | A61K 31/74 |
| WO 94/27946 | 12/1994 | WIPO . | |

OTHER PUBLICATIONS

March, J., "Reactions, Mechanisms, and Structure", Advanced Organic Chemistry, 3rd Ed., J. Wiley & Sons, N.Y., pp. 329–332 (1985).

Escher, S.D., et al., "Quantitative Study of Factors that Influence the Substantivity of Fragrance Chemicals on Laundered and Dried Fabrics", JAOCS, vol. 71, No. 1, pp. 31–40 (1994).

*Primary Examiner*—John R. Hardee
*Attorney, Agent, or Firm*—Richard S. Echler, Sr.; Kim W. Zerby; Brian M. Bolam

[57] ABSTRACT

Rinse added fabric softening compositions containing profragrant acetals or ketals which hydrolyze upon exposure of surfaces rinsed in solution of said compositions to a reduction in pH, thereby releasing a fragrance which is characteristic of one or more of the hydrolysis products.

13 Claims, No Drawings

RINSE ADDED FABRIC SOFTENING COMPOSITIONS AND METHOD OF USE FOR THE DELIVERY OF FRAGRANCE PRECURSORS

This application claims the priority of Provisional U.S. Application 60/023,786, filed Aug. 12, 1996.

FIELD OF THE INVENTION

The present invention relates to rinse added fabric softening compositions containing acetal and ketal pro-fragrance compounds and methods for accomplishing the delivery of such organic pro-fragrance compounds to textile articles and other surfaces rinsed with said compositions. More particularly, the invention relates to rinse added fabric softening compositions in which there is a delayed release of fragrances from surfaces rinsed in an aqueous bath in the presence of conventional fabric softening ingredients. The fragrance is released in fragrance-active form when the rinsed surface is subsequently contacted with a lower pH environment such as contact with water, carbon dioxide gas, humid air, or the like.

BACKGROUND OF THE INVENTION

Most consumers have come to expect scented laundry products and to expect that fabrics which have been laundered to also have a pleasing fragrance. It is also desired by consumers for laundered fabrics to maintain the pleasing fragrance over time. Perfume additives make laundry compositions more aesthetically pleasing to the consumer, and in some cases the perfume imparts a pleasant fragrance to fabrics treated therewith. However, the amount of perfume carry-over from an aqueous laundry bath onto fabrics is often marginal and does not last long on the fabric. Fragrance materials are often very costly and their inefficient use in rinse added fabric softener compositions and ineffective delivery to fabrics from the rinse results in a very high cost to both consumers and fabric softener manufacturers. Industry, therefore, continues to seek with urgency for more efficient and effective fragrance delivery in fabric softener products, especially for improvement in the provision of long-lasting fragrance to the rinsed fabrics.

Acetals and ketals have long been known in perfumery. See Steffen Arctander, "Perfume and Flavor Chemicals", Arctander, N.J., 1969. The majority of these are methyl and ethyl types, and molecular weights may range widely. See, for example, Arctander abstract numbers 6, 11, 210, 651, 689, 1697, 1702, 2480, 2478. For 2478, which is phenylacetaldehyde dicitronellyl acetal, molecular weight 414.7, Aictander reports ". . . and it is not exaggerated to say that this acetal is practically abandoned and obsolete in today's perfumery". For 2480, which is phenylacetaldehyde digeranyl acetal, Arctander reports "the title material does not offer substantial advantages or unique odor type and it may be considered of little more than academic interest today". This latter material was still commercially available in 1992 as ROSETAL A (Catalogue, IFF).

Carrier mechanisms for perfume delivery, such as by encapsulation, have been taught in the prior art. See for example, U.S. Pat. No. 5,188,753.

U.S. Pat. No. 5,378,468, Suffis et al, issued Jan. 3, 1995 describes specific types of personal care compositions, such as deodorant sticks, comprising assertedly "body-activated" fragrances. The term apparently refers to the previously known tendency Of materials such as acetals derived from fragrance alcohols to hydrolyze under acidic pH conditions thereby releasing fragrance. See, for example, U.S. Pat. No. 3,932,520, Hoffman, issued Jan. 13, 1976.

Factors affecting substantivity of fragrance materials on fabrics are discussed in Estcher et al. JAOCS 71 p. 31–40 (1994).

The selected potential fragrance materials described by Suffis et al include particular acetals and ketals, exemplified by propylene glycol vanillin acetal. The materials exemplified apparently are rather hydrophilic short chain alcohol or diol derivatives of fragrance aldehydes and upon hydrolysis, deliver one mole of the aldehyde per mole of the potential fragrance material. The present inventors believe that short chain hydrophilic acetal materials are incompatible with acidic rinse added fabric softening compositions as described hereinafter. The Suffis et al development is designed to be incorporated with a personal care product vehicle, resulting in clear deodorant sticks and the like.

For rinse added fabric softening use, it is important that rather hydrophobic pro-fragrant compounds be used in order to enhance deposition onto surfaces in the wash solution and retention on the washed surface during rinsing. In Suffis et al, the compositions containing the potential fragrance materials are applied directly to the substrate (i.e. skin); therefore, the deposition problems resulting from dilution, rinsing, etc. are not at issue.

Acetals and ketals are conventionally known to be stable in basic, and unstable in acidic media. Indeed, acetals are frequently used in chemical synthesis as protecting groups for alcohols and aldehydes in basic pH systems. See, for example, March, Advanced Organic Chemistry, 3rd Ed., pp. 329–332 (Wiley, N.Y., 1985). When used as a protecting group, subsequent treatment of an acetal under acidic conditions liberates the parent alcohol and aldehyde.

It has now been discovered that pro-fragrance and pro-accord acetal and ketals compounds are surprisingly stable in the context of rinse added fabric softening compositions. While as not to be limited by theory, it is believed that this surprising enhancement in stability results from an interaction between the acetal pro-perfume and the fabric softening agents described herein. Specifically, it is believed that the hydrophobic pro-perfume associates with the vesicles contained in the product and is thereby protected from the acidic aqueous (continuous) phase of the product.

SUMMARY OF THE INVENTION

The present invention meets the aforementioned needs in that it has been surprisingly discovered that acetals and ketals are capable of imparting residual fragrances to surfaces rinsed with aqueous solutions of said compounds. In addition, it has been surprisingly discovered that more than one perfume or fragrance raw material (accord) can be released from one precursor pro-accord acetal or ketal molecule. The pro-fragrance acetal and ketal compounds described herein comprises fragrances in a stable, releasable "pro-fragrance" or "pro-accord" form. The compounds can be formulated into any product which is deliverable to fabric via the laundry rinse cycle, directly or indirectly, provided the product pH, carriers and adjunct materials are compatible with the pro-fragrance or pro-accord chemical form. Once in contact with fabric, the pro-accord is converted to the fragrance raw material mixture at a rate which provides extended fragrance benefits. The fragrance delivery systems of the present invention can be a mixture of any number of pro-fragrances or pro-accords and can cover any fragrance "characteristic" or desired fragrance volatility.

The first aspect of the present invention relates to compositions which are applied to fabric, said compositions having increased fragrance retention and fragrance longevity. The suitable compositions of the present invention are rinse added fabric softening compositions, comprising:

a) from about 0.01% to about 15% of pro-accord having the formula:

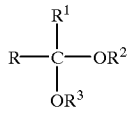

wherein R is $C_3$–$C_{20}$ linear alkyl, $C_4$–$C_{20}$ branched alkyl, $C_6$–$C_{20}$ cyclic alky, $C_6$–$C_{20}$ branched cyclic alky, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ substituted or unsubstituted aryl, and mixtures thereof; $R^1$ is hydrogen or R; $R^2$ and $R^3$are each independently selected from the group consisting of $C_5$–$C_{20}$ linear alkyl, $C_4$–$C_{20}$ branched alkyl, $C_6$–$C_{20}$ cyclic alkyl, $C_6$–$C_{20}$ branched cyclic alkyl, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ aryl, $C_7$–$C_{20}$ substituted aryl, and mixtures thereof; and (b) from about 85% to about 99.99%, by weight of the composition, of ingredients useful for formulating fabric softening compositions;

wherein said compositions have a neat pH of less than about 6, preferably from about 2.0 to about 4.5, and more preferably from about 2.0 to about 3.5 at 20° C.

The compositions of the present invention preferably comprise from about 1% to about 80%, preferably from about 5 to about 50% of cationic fabric softening compound. Dilute liquid compositions of the present invention preferably contain from about 5% to about 15% of cationic fabric softening compound. Concentrated liquid compositions of the present invention preferably contain from about 15% to about 50%, more preferably from about 15% to about 35% of cationic fabric softening compound. Preferably, the cationic fabric softening compound is selected from biodegradable quaternary ammonium compounds as described hereinafter.

The present invention also relates to a method for contacting compositions comprising said pro-accord acetals and ketals described hereinbefore with a fabric. Preferred is a method for laundering soiled fabrics, comprising contacting said fabrics with an aqueous medium containing at least about 50 ppm, preferably from about 100 ppm to about 10,000 ppm of a rinse added fabric softening composition according to the above, preferably with agitation. Said method includes the process of treating textiles in a rinse cycle of a washing machine comprising the step of contacting textiles in a washing machine with a fabric softening effective amount of a rinse added fabric softening composition comprising: comprising:

(a) from about 0.01% to about 15% by weight, of a pro-accord described herein below; and (b) from about 85% to about 99.99%, by weight of the composition, of ingredients useful for formulating fabric softening compositions;

wherein said composition has a neat pH of less than about 6 at 20° C.

These and other objects, features and advantages will become apparent to those of ordinary skill in the art from a reading of the following detailed description and the appended claims.

All percentages, ratios and proportions herein are by weight, unless otherwise specified. All temperatures are in degrees Celsius (°C.) unless otherwise specified. All documents cited are in relevant part, incorporated herein by reference.

All percentages, ratios and proportions herein are by weight, unless otherwise specified. All documents cited are, in relevant part, incorporated herein by reference.

DETAILED DESCRIPTION OF THE INVENTION

The rinse added fabric softening compositions of the present invention comprise a fragrance delivery system which lays down one or more acetal or ketal pro-fragrances or pro-accords onto fabric during usage. Because the pro-accords of the present invention generally have a higher molecular weight than uncombined fragrance raw materials and other "pro-fragrance-type" compounds (i.e. pro-fragrances which only deliver a single equivalent of a fragrance raw material), they are a means for effectively delivering two or more fragrance raw materials in a manner which results in enhanced longevity of the fragrance raw materials on fabric.

Fragrances or scents are known by those skilled in the art of fragrances and perfumes as single fragrance raw material compounds while in mixtures of fragrance raw materials are known as "accords". The term "accord" as used herein is defined as "a mixture of two or more 'fragrance raw materials' which are artfully combined to impart a pleasurable scent, odor, essence, or fragrance characteristic". For the purposes of the present invention "fragrance raw materials" are herein defined as compounds having a molecular weight of at least 100 g/mol and which are useful in imparting an odor, fragrance, essence, or scent either alone or in combination with other "fragrance raw materials".

Typically "fragrance raw materials" comprise inter alia alcohols, ketones, aldehydes, esters, ethers, nitriles, and cyclic and acyclic alkenes such as terpenes. A listing of common "fragrance raw materials" can be found in various reference sources, for example, "Perfume and Flavor Chemicals", Vols. I and II; Steffen Arctander Allured Pub. Co. (1994) and "Perfumes: Art, Science and Technology"; Muller, P. M. and Lamparsky, D., Blackie Academic and Professional (1994) both incorporated herein by reference.

For example, but not by way of limitation, the fragrances or fragrance accords released by the acetals and ketals of the present invention have a "heart", "character", or "note" which is described as inter alia rose, jasmin, lilac, lily of the valley, violet, orange, peach, watermelon, and lemon. Accords may be further "modified" or "twisted" by the use of modifier top or middle notes which, as an additional benefit afforded by the present invention, can be incorporated into the pro-accord. For example, a "rose essence" may be combined with a "green" modifier to "shift the fragrance accord character".

Pro-Fragrances and Pro-Accords

The pro-fragrances of the present invention are acetal or ketals which deliver a single fragrance raw material. The pro-accords of the present invention deliver two or more fragrance raw materials. The fragrance raw materials selected to comprise the final released fragrance or accord are converted into a chemical species or reactive chemical form which releases the fragrance raw materials when the pro-fragrance or pro-accord is subjected to the proper conditions which trigger their release. The chemically modified forms of the fragrance raw materials in their releasable-form are the acetal and ketal "pro-fragrances" or "pro-accords" of the present invention.

Molecular Weight

The pro-fragrances and pro-accords of the present invention generally have a molecular weight of at least 300 g/mol, preferably greater than 325 g/mol, more preferably greater than 350 g/mol. It is also a condition of the present invention that the final molecular weight of the pro-accord is at least 2 times, preferably at least 2.25 times, more preferably 2.5 times, most preferably at least 2.75 times the molecular weight of the lowest fragrance material component.

For the purposes of the present invention, only fragrance raw materials having a molecular weight of at least 100 g/mol are considered "fragrance raw materials" according to the present invention. Therefore, low molecular weight materials inter alia methanol, ethanol, methyl acetate, ethyl acetate, and methyl formate which are common components of fragrance accords are excluded from the class of compounds defined herein as "fragrance raw materials". However, the formulator may wish to deliver these lower molecular weight materials (less than a molecular weight of 100 g/mol) as carriers, astringents, diluents, balancers, fixatives, or as other suitable adjunct materials.

By way of illustration and not limitation, the pro-accord di(9-decen-1-yl) 3-(4-tert-butylphenyl)-2-methylpropanal acetal is formed from two equivalents of the alcohol 9-decen-1-ol and one equivalent of the aldehyde 3-(4-tert-butylphenyl)-2-methylpropanal (p-t-bucinal) which comprise the released binary accord. This pro-accord has a molecular weight of approximately 499 g/mol. The lowest molecular weight fragrance raw material which is a component of this pro-accord is 9-decen-1-ol which has a molecular weight of approximately 156 g/mol. Therefore di(9-decen-1-yl) 3-(4-tert-butylphenyl)-2-methylpropanal acetal has a molecular weight greater than 3 times the molecular weight of the lowest molecular weight fragrance raw material component (9-decen-1-ol) and hence is a most preferred pro-accord.

For the purposes of the present invention substituted or unsubstituted alkyleneoxy units are defined as moieties having the formula:

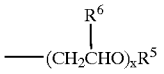

wherein $R^5$ is hydrogen; $R^6$ is hydrogen, methyl, ethyl, and mixtures thereof; the index x is from 1 to about 20.

For the purposes of the present invention substituted or unsubstituted alkyleneoxyalkyl are defined as moieties having the formula:

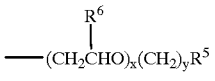

wherein $R^5$ is hydrogen, $C_1$–$C_{18}$ alky, $C_1$–$C_4$ alkoxy, and mixtures thereof; $R^6$ is hydrogen, methyl, ethyl, and mixtures thereof; the index x is from 1 to about 20 and the index y is from 2 to about 30.

For the purposes of the present invention substituted or unsubstituted alkylenearyl units are defined as moieties having the formula:

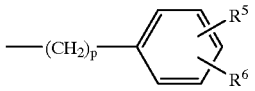

wherein $R^5$ and $R^6$ are each independently hydrogen, hydroxy, $C_1$–$C_4$ alkoxy, nitrilo, halogen, nitro, carboxyl (—CHO; —$CO_2H$; —$CO_2R'$; —$CONH_2$; —CONHR'; —$CONR'_2$; wherein R' is $C_1$–$C_{12}$ linear or branched alkyl), amino, alkylamino, and mixtures thereof, p is from 1 to about 34.

For the purposes of the present invention substituted or unsubstituted aryloxy units are defined as moieties having the formula:

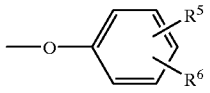

wherein $R^5$ and $R^6$ are each independently hydrogen, hydroxy, $C_1$–$C_4$ alkoxy, nitrilo, halogen, nitro, carboxyl (—CHO; —$CO_2H$; —$CO_2R'$; —$CONH_2$; —CONHR'; —$CONR'_2$; wherein R' is $C_1$–$C_{12}$ linear or branched alkyl), amino, alkylamino, and mixtures thereof.

For the purposes of the present invention substituted or unsubstituted alkyleneoxyaryl units are defined as moieties having the formula:

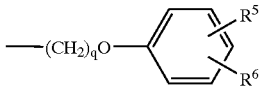

wherein $R^5$ and $R^6$ are each independently hydrogen, hydroxy, $C_1$–$C_4$ alkoxy, nitrilo, halogen, nitro, carboxyl (—CHO; —$CO_2H$; —$CO_2R'$; —$CONH_2$; —CONHR'; —$CONR'_2$; wherein R' is $C_1$–$C_{12}$ linear or branched alkyl), amino, alkylamino, and mixtures thereof, q is from 1 to about 34.

For the purposes of the present invention substituted or unsubstituted oxyallylenearyl units are defined as moieties having the formula:

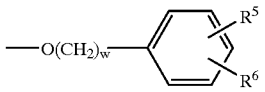

wherein $R^5$ and $R^6$ are each independently hydrogen, hydroxy, $C_1$–$C_4$ alkoxy, nitrilo, halogen, nitro, carboxyl (—CHO; —$CO_2H$; —$CO_2R'$; —$CONH_2$; —CONHR'; —$CONR'_2$; wherein R' is $C_1$–$C_{12}$ linear or branched alkyl), amino, alkylamino, and mixtures thereof, w is from 1 to about 34.

The pro-fragrances and pro-accords according to the present invention are acetals and ketals having the formula:

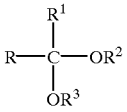

wherein hydrolysis of the acetal or ketal releases one equivalent of aldehyde or ketone and two equivalents of alcohol according to the following scheme:

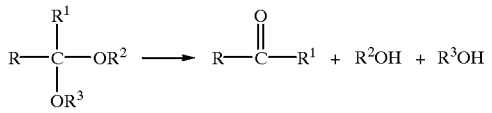

wherein R is $C_1$–$C_{20}$ linear alkyl, $C_4$–$C_{20}$ branched alkyl, $C_6$–$C_{20}$ cyclic alkyl, $C_6$–$C_{20}$ branched cyclic alkyl, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ substituted or unsubstituted aryl, preferably the moieties which substitute the aryl units are alkyl moieties, and mixtures thereof. $R^1$ is hydrogen, R, or in the case wherein the pro-fragrance or pro-accord is a ketal, R and $R^1$ can be taken together to form a ring. $R^2$ and $R^3$ are independently selected from the group consisting of $C_5$–$C_{20}$ linear, branched, or substituted alkyl; $C_4$–$C_{20}$ linear, branched, or substituted alkenyl; $C_5$–$C_{20}$ substituted or unsubstituted cyclic alkyl; $C_6$–$C_{20}$ substituted or unsubstituted aryl, $C_2$–$C_{40}$ substituted or unsubstituted alkyleneoxy; $C_3$–$C_{40}$ substituted or unsubstituted alkyleneoxyalkyl; $C_6$–$C_{40}$ substituted or unsubstituted alkylenearyl; $C_6$–$C_{32}$ substituted or unsubstituted aryloxy; $C_6$–$C_{40}$ substituted or unsubstituted alkyleneoxyaryl; $C_6$–$C_{40}$ oxyalkylenearyl; and mixtures thereof. By the term "substituted" herein is meant "compatible moieties which replace a hydrogen atom". Non-limiting examples of substituents are hydroxy, nitrilo, halogen, nitro, carboxyl (—CHO; —$CO_2$H; —$CO_2$R'; —$CONH_2$; —CONHR'; —$CONR'_2$; wherein R' is $C_1$–$C_{12}$ linear or branched alkyl), amino, $C_1$–$C_{12}$ mono- and dialkylamino, and mixtures thereof.

Non-limiting examples of $R^2$ and $R^3$ include methyl, 2,4-dimethyl-3-cyclo-hexene-1-methyl (Floralol), 2,4-dimethyl cyclohexane methyl (Dihydro floralol), 5,6-dimethyl-1-methylethenyl-bicyclo[2.2.1]hept-5-ene-2-methyl (Arbozol), 2,4,6-trimethyl-3-cyclohexene-1-methyl (Isocyclo geranyl), 4-(1-methylethyl)cyclohexylmethyl (Mayol), α-3,3-trimethyl-2-norboranylmethyl, 1,1-dimethyl-1-(4-methylcyclohex-3-enyl)methyl, ethyl, 2-phenylethyl, 2-cyclohexylethyl, 2-(o-methylphenyl)ethyl, 2-(m-methylphenyl)ethyl, 2-(p-methylphenyl)ethyl, 6,6-dimethylbicyclo[3.1.1]hept-2-ene-2-ethyl (nopyl), 2-(4-30 methylphenoxy)ethyl, 3,3-dimethyl-$\Delta^2$-β-norbornanylethyl, 2-methyl-2-cyclohexylethyl, 1-(4-isopropylcyclohexyl) ethyl, 1-phenyl-1-hydroxyethyl, 1,1-dimethyl-2-phenylethyl, 1,1-dimethyl-2-(4-methylphenyl)ethyl, propyl, 1-phenylpropyl, 3-phenylpropyl, 2-phenylpropyl (Hydrotropic Alcohol), 2-(cyclododecyl)-propan-1-yl (Hydroxyambran), 2,2-dimethyl-3-(3-methylphenyl) propan-1-yl (Majantol), 2-methyl-3-phenylpropyl, 3-phenyl-2-propen- 1-yl (cinnamyl alcohol), 2-methyl-3-phenyl-2-propen-1-yl (methylcinnamyl alcohol), α-n-pentyl-3-phenyl-2-propen-1-yl (α-amylcinnamyl alcohol), ethyl-3-hydroxy-3-phenyl propionate, 2-(4-methylphenyl)-2-propyl, butyl, 3-methylbutyl, 3-(4-methylcyclohex-3-ene) butyl, 2-methyl-4-(2,2,3-trimethyl-3-cyclopenten-1-yl) butyl, 2-ethyl-4-(2,2,3-trimethylcyclopent-3-enyl)-2-buten-1-yl, 3-methyl-2-buten-1-yl, 2-methyl-4-(2,2,3-trimethyl-3-cyclopenten-1-yl)-2-buten-1-yl, 3-hydroxy-2-butanone, ethyl 3-hydroxybutyrate, 4-phenyl-3-buten-2-yl, 2-methyl-4-phenylbutan-2-yl, 4-(4-hydroxyphenyl)butan-2-one, 4-(4-hydroxy-3-methoxyphenyl)butan-2-one, pentyl, cis-3-pentenyl, 3-methylpentyl, 3-methyl-3-penten-1-yl, 2-methyl-4-phenylpentyl (Pamplefleur), 3-methyl-5-phenylpentyl (Phenoxanyl), 2-methyl-5-phenylpentyl, 2-methyl-5-(2,3-dimethyltricyclo-[2.2.1.0(2,6)]hept-3-yl)-2-penten-1-yl (santalyl), 4-methyl-1-phenyl-2-pentyl, (1-methyl-bicyclo[2.1.1]hepten-2-yl)-2-methylpent-1-en-3-yl, 3-methyl-1-phenylpent-3-yl, 1,2-dimethyl-3-(1-methylethenyl)cyclopent-1-yl, 2-isopropyl-4-methyl-2-hexenyl, cis-3-hexen-1-yl, trans-2-hexen-1-yl, 2-isopropenyl-5-methyl4-hexen-1-yl (Lavandulyl), 2-ethyl-2-prenyl-3-hexenyl (silwanol), 2-ethylhexyl, 1-hydroxymethyl-4-isopropenyl-1-cyclohexenyl (Dihydrocuminyl), 1-methyl4-isopropenylcyclohex-6-en-2-yl (carvenyl), 6-methyl-3-isopropenylcyclohex-1-yl, 1-methyl-4-isopropenylcyclohex-3-yl, 4-iso-propyl-1-methylcyclohex-3-yl, 4-tert-butylcyclohexyl, 2-tert-butylcyclohexyl, 2-tert-butyl-4-methylcyclohexyl, 4-isopropylcyclohexyl, 4-methyl-1-(1-methylethyl)-3-cyclohexen-1-yl, 2-(5,6,6-trimethyl-2-norbomyl) cyclohexyl, isobornylcyclohexyl, 3,3,5-trimethylcyclohexyl, 1-methyl-4-isopropylcyclohex-3-yl (menthol), 1,2-dimethyl-3-(1-methylethyl)-cyclohexan-1-yl, heptyl, 2,4-dimethylhept-1-yl, 2,4-dimethyl-2,6-heptandienyl, 6,6-dimethyl-2-oxymethylbicyclo[3.1.1]hept-2-en-1-yl (myrtenyl), 4-methyl-2,4-heptadien-1-yl, 3,4,5,6,6-pentamethyl-2-heptyl, 3,6-dimethyl-3-vinyl-5-hepten-2-yl, 6,6-dimethyl-3-hydroxy-2-methylenebicyclo[3.1.1]-heptyl, 1,7,7-trimethylbicyclo-[2.2.1]hept-2-yl, 2,6-dimethylhept-2-yl, 2,6,6-trimethylbicyclo[1.3.3]hept-2-yl, octyl, 2-octenyl, 2-methyloctan-2-yl, 2-methyl-6-methylene-7-octen-2-yl (myrcenyl), 7-methyloctan-1-yl, 3,7-dimethyl-6-octenyl, 3,7-dimethyl-7-octenyl, 3,7-dimethyl-6-octen-1-yl (citronellyl), 3,7-dimethyl-2,6-octadien-1-yl (geranyl), 3,7-dimethyl-2,6-octadien-1-yl (neryl), 3,7-dimethyl-1,6-octadien-3-yl (linalyl), 3,7-dimethyloctan-1-yl (pelagryl), 3,7-dimethyloctan-3-yl (tetrahydrolinalyl), 2,4-octadien-1-yl, 3,7-dimethyl-6-octen-3-yl, 2,6-dimethyl-7-octen-2-yl, 2,6-dimethyl-5,7-octadien-2-yl, 4,7-dimethyl-4-vinyl-6-octen-3-yl, 3-methyloctan-3-yl, 2,6-dimethyloctan-2-yl, 2,6-dimethyloctan-3-yl, 3,6-dimethyloctan-3-yl, 2,6-dimethyl-7-octen-2-yl, 2,6-dimethyl-3,5-octadien-2-yl (mugyl), 3-methyl-1-octen-3-yl, 7-hydroxy- 3,7-dimethyloctanalyl, 3-nonyl, 6,8-dimethylnonan-2-yl, 3-(hydroxymethyl)-2-nonanone, 2-nonen-1-yl, 2,4-nonadien-1-yl, 2,6-nonadien-1-yl, cis-6-nonen-1-yl, 3,7-dimethyl-1,6-nonadien-3-yl, decyl, 9-decenyl, 2-benzyl-M-dioxa-5-yl, 2-decen-1-yl, 2,4-decadien-1-yl, 4-methyl-3-decen-5-yl, 3,7,9-trimethyl-1,6-decadien-3-yl (isobutyl linallyl), undecyl, 2-undecen-1-yl, 10-undecen-1-yl, 2-dodecen-1-yl, 2,4-dodecadien-1-yl, 2,7,11-trimethyl-2,6,10-dodecatrien-1-yl (farnesyl), 3,7,11-trimethyl-1,6,10,-dodecatrien-3-yl, 3,7,11,15-tetramethylhexadec-2-en-1-yl (phytyl), 3,7,11,15-tetramethylhexadec-1-en-3-yl (iso phytol), benzyl, p-methoxybenzyl (anisyl), para-cymen-7-yl (cuminyl), 4-methylbenzyl, 3,4-methylenedioxybenzyl, 2-(methyl) carboxy-1-hydroxyphenyl, 2-(benzyl)carboxy-1-hydroxyphenyl, 2-(cis-3-hexenyl)-carboxy-1-hydroxyphenyl, 2-(n-pentyl)carboxy-1-hydroxyphenyl, 2-(2-phenylethyl)carboxy-1-hydroxyphenyl, 2-(n-hexyl) carboxy-1-hydroxyphenyl, 2-methyl-5-isopropyl-1-hydroxyphenyl, 4-ethyl-2-methoxyphenyl, 4-allyl-2-methoxy-1-hydroxyphenyl (eugenyl), 2-methoxy4-(1-propenyl)-1-hydroxyphenyl (isoeugenyl), 4-allyl-2,6-dimethoxy-1-hydroxyphenyl, 4-tert-butyl-1-hydroxyphenyl, 2-ethoxy-4-methyl-1-hydroxyphenyl, 2-methyl-4-vinyl-1-hydroxyphenyl, 2-isopropyl-5-methyl-1-hydroxyphenyl (thymyl), 2-(isopentyl)-carboxy-1-hydroxyphenyl, 2-(ethyl)

carboxy-1 -hydroxyphenyl, 6-(methyl)carboxy-2,5-dimethyl-1,3-dihydroxyphenyl, 5-methoxy-3-methyl-1-hydroxyphenyl, 2-tert-butyl-4-methyl-1-hydroxyphenyl, 1-ethoxy-2-hydroxy-4-propenylphenyl, 4-methyl-1-hydroxyphenyl, 4-hydroxy-3-methoxybenzaldehyde, 2-ethoxy-4-hydroxybenzaldehyde, decahydro-2-naphthyl, 2,5,5-trimethyl-octahydro-2-naphthyl, 1,3,3-trimethyl-2-norbornyl (fenchyl), 3a,4,5,6,7,7a-hexahydro-2,4-dimethyl-4,7-methano-1H-inden-5-yl, 3a,4,5,6,7,7a-hexahydro-3,4-dimethyl4,7-methano-1H-inden-5-yl, 2-methyl-2-vinyl-5-(1-hydroxy-1-methylethyl)tetrahydrofuranyl, β-caryophyllenyl, and mixtures thereof.

Acetal Releasable Components: The acetals of the present invention have two types of releasable components, namely alcohols and aldehydes. Hydrolysis of an acetal will yield two equivalents of releasable alcohol and one equivalent of releasable aldehyde. In the case of pro-accords, the released aldehyde, when taken together with the released fragrance raw material alcohol, forms a fragrance accord. For example bis(cis-3-hexenyl) vanillin acetal releases the accord vanillin/cis-3-hexenol.

When $R^1$ is hydrogen the pro-fragrances or pro-accords are capable of releasing an aldehyde component. Preferred aldehydes which are releasable components of the acetals of the present invention include but are not limited to phenylacetaldehyde, p-methyl phenylacetaldehyde, p-isopropyl phenylacetaldehyde, methylnonyl acetaldehyde, phenylpropanal, 3-(4-t-butylphenyl)-2-methyl propanal (Lilial), 3-(4-t-butylphenyl)-propanal (Bourgeonal), 3-(4-methoxyphenyl)-2-methylpropanal (Canthoxal), 3-(4-isopropylphenyl)-2-methylpropanal (Cymal), 3-(3,4-methylenedioxyphenyl)-2-methylpropanal (Helional), 3-(4-ethylpheny)-2,2-dimethylpropanal (Floralozone), phenylbutanal, 3-methyl-5-phenylpentanal, hexanal, trans-2-hexenal, cis-hex-3-enal, heptanal, cis-4-heptenal, 2-ethyl-2-heptenal, 2,6-dimethyl-5-heptenal (Melonal), 2,4-heptadienal, octanal, 2-octenal, 3,7-dimethyloctanal, 3,7-dimethyl-2,6-octadien-1-al, 3,7-dimethyl-1,6-octadien-3-al, 3,7-dimethyl-6-octenal, 3,7-dimethyl-7-hydroxyoctan- 1-al, nonanal, 6-nonenal, 2,4-nonadienal, 2,6-nonadienal, decanal, 2-methyl decanal, 4-decenal, 9-decenal, 2,4-decadienal, undecanal, 2-methyldecanal, 2-methylundecanal, 2,6,10-trimethyl-9-undecenal (Adoxal), undec-10-enyl aldehyde, undec-8-enanal, dodecanal, tridecanal, tetradecanal, anisaldehyde, bourgenonal, cinnamic aldehyde, α-amylcinnam-aldehyde, α-hexyl cinnamaldehyde, methoxy-cinnamaldehyde, citronellal, hydroxy-citronellal, isocyclocitral, citronellyl oxyacetaldehyde, cortexaldehyde, cumminic aldehyde cyclamen aldehyde, florhydral, heliotropin, hydrotropic aldehyde, lilial, vanillin, ethyl vanillin, benzaldehyde, p-methyl benzaldehyde, 3,4-dimethoxybenzaldehyde, 3- and 4-(4-hydroxy-4-methyl-pentyl)-3-cyclohexene-1-carboxaldehyde (Lyral), 2,4-dimethyl-3-cyclohexene-1-carboxaldehyde (Triplal), 1-methyl-3-(4-methylpentyl)-3-cyclohexencarboxaldehyde (Vernaldehyde), p-methylphenoxyacetaldehyde (Xi aldehyde), and mixtures thereof More preferably the aldehydes released by the acetals of the present invention are 4-(4-hydroxy-4-methylpentyl)-3-cyclohexene-1-carboxaldehyde (lyral), phenylacettaldehyde, methylnonyl acetaldehyde, 2-phenylpropan-1-al (hydrotropaldehyde), 3-phenylprop-2-en-1-al (cinnamaldehyde), 3-phenyl-2-pentylprop-2-en-1-al (α-amylcinnamaldehyde), 3-phenyl-2-hexylprop-2-enal (α-hexylcinnamaldehyde), 3-(4-isopropylphenyl)-2-methylpropan-1-al (cyclamen aldehyde), 3-(4-ethylphenyl)-2,2-dimethylpropan-1-al (floralozone), 3-(4-tert-butylphenyl)-2-methylpropanal, 3-(3,4-methylenedioxyphenyl)-2-methylpropan-1-al (helional), 3-(4-ethylphenyl)-2,2-dimethylpropanal, 3-(3isopropylphenyl)butan-1-al (flohydral), 2,6-dimethylhep-5-en-1-al (melonal), n-decanal, n-undecanal, n-dodecanal, 3,7-dimethyl-2,6-octadien-1-al (citral), 4-methoxybenzaldehyde (anisaldehyde), 3-methoxy-4-hydroxybenzaldehyde (vanillin), 3-ethoxy-4-hydroxybenzaldehyde (ethyl vanillin), 3,4-methylenedioxybenzaldehyde (heliotropin), 3,4-dimethoxybenzaldehyde Ketal Releasable Components: The ketals of the present invention have two types of releasable components, namely alcohols and ketones. Hydrolysis of a ketal will yield two equivalents of releasable alcohol and one equivalent of releasable ketone. In the case of pro-accords, the released ketone, when taken together with the released fragrance raw material alcohol, forms a fragrance accord. For example bis(linalyl) β-ionone ketal releases the accord linalool/β-ionone.

When $R^1$ is a moiety as described herein above other than hydrogen, the pro-fragrances or pro-accords are capable of releasing an ketone component. Preferred ketones which are releasable components of the ketals of the present invention include but are not limited to α-damascone, β-damascone, δ-damascone, β-damascenone, muscone, 6,7-dihydro-1,1,2,3,3-pentamethyl-4(5H)-indanone (cashmeran), cis-jasmone, dihydrojasmone, α-ionone, β-ionone, dihydro-β-ionone, γ-methyl ionone, α-iso-methyl ionone, 4-(3,4-methylenedioxyphenyl)butan-2-one, 4-(4-hydroxyphenyl) butan-2-one, methyl β-naphthyl ketone, methyl cedryl ketone, 6-acetyl-1,1,2,4,4,7-hexamethyltetralin (tonalid), l-carvone, 5-cyclohexadecen-1-one, acetophenone, decatone, p-hydroxyphenylbutan-2-one, $^2$-[2-(4-methyl-3-cyclohexenyl-1-yl)propyl[cyclopentan-2-one, 2-sec-butylcyclohexanone, β-dihydro ionone, allyl ionone, α-irone, α-cetone, α-irisone, acetanisole, geranyl acetone, 1-(2-methyl-5-isopropyl-2-cyclohexenyl)-1-propanone, acetyl diisoamylene, methyl cyclocitrone, 4-t-pentyl cyclohexanone, p-t-butylcyclohexanone, o-t-butylcyclohexanone, ethyl amyl ketone, ethyl pentyl ketone, menthone, methyl-7,3-dihydro-2H-1,5-benzodioxepine-3-one, fenchone, and mixtures thereof.

More preferably the ketones which are released by the ketals of the present invention are α-damascone, β-damascone, γ-damascone, β-damascenone, muscone, 6,7-dihydro-1,1,2,3,3-pentamethyl-4(5H)-indanone (cashmeran), cis-jasmone, dihydrojasmone, α-ionone, β-ionone, dihydro-β-ionone, γ-methyl ionone, α-iso-methyl ionone, 4-(3,4-methylenedioxyphenyl)butan-2-one, 4-(4-hydroxyphenyl)butan-2-one, methyl β-naphthyl ketone, methyl cedryl ketone, 6-acetyl-1,1,2,4,4,7-hexamethyltetralin (tonalid), 1-carvone, 5-cyclohexadecen-1-one, and mixture thereof.

Non-limiting examples of alcohols suitably released by the hydrolysis of the acetals and ketals include methanol, 2,4-dimethyl-3-cyclohexene-1-methanol (Floraloi), 2,4-dimethyl cyclohexane methanol (Dihydro floralol), 5,6-dimethyl-1-methylethenylbicyclo[2.2.1]hept-5-ene-2-methanol (Arbozol), 2,4,6-trimethyl-3-cyclohexene-1-methanol (Isocyclo geraniol), 4-(1-methylethyl) cyclohexanemethanol (Mayol), α-3,3-trimethyl-2-norborane methanol, 1,1-dimethyl-1-(4-methylcyclohex-3-enyl)methanol, ethanol, 2-phenylethanol, 2-cyclohexyl ethanol, 2-(o-methylphenyl)-ethanol, 2-(m-methylphenyl) ethanol, 2-(p-methylphenyl)ethanol, 6,6-dimethylbicyclo-

[3.1.1]hept-2-ene-2-ethanol (nopol), 2-(4-methylphenoxy) ethanol, 3,3-dimethyl-$\Delta^2$-β-norbornane ethanol, 2-methyl-2-cyclohexylethanol, 1-(4-isopropylcyclohexyl)-ethanol, 1-phenylethanol, 1,1-dimethyl-2-phenylethanol, 1,1-dimethyl-2-(4-methyl-phenyl)ethanol, n-propanol, 2-propanol, 1-phenylpropanol, 3-phenylpropanol, 2-phenylpropanol (Hydrotropic Alcohol), 2-(cyclododecyl) propan-1-ol (Hydroxy-ambran), 2,2-dimethyl-3-(3-methylphenyl)propan-1-ol (Majantol), 2-methyl-3-phenylpropanol, 3-phenyl-2-propen-1-ol (cinnamyl alcohol), 2-methyl-3-phenyl-2-propen-1-ol (methylcinnamyl alcohol), α-n-pentyl-3-phenyl-2-propen-1-ol (α-amyl-cinnamyl alcohol), ethyl-3-hydroxy-3-phenyl propionate, 2-(4-methylphenyl)-2-propanol, n-butanol, 2-butanol, 3-methylbutanol, 3-(4-methylcyclohex-3-ene) butanol, 2-methyl-4-(2,2,3-trimethyl-3-cyclopenten-1-yl) butanol, 2-ethyl-4-(2,2,3-trimethyl-cyclopent-3-enyl)-2-buten-1-ol, 3-methyl-2-buten-1-ol, 2-methyl-4-(2,2,3-trimethyl-3-cyclopenten-1-yl)-2-buten-1-ol, 3-hydroxy-2-butanone, ethyl 3-hydroxybutyrate, 4-phenyl-3-buten-2-ol, 2-methyl-4-phenylbutan-2-ol, 4(4-hydroxyphenyl)butan-2-one, 4-(4-hydroxy-3-methoxyphenyl)butan-2-one, pentanol, cis-3-pentenol, 3-methyl-pentanol, 3-methyl-3-penten-1-ol, 2-methyl-4-phenylpentanol (Pamplefleur), 3-methyl-5-phenylpentanol (Phenoxanol), 2-methyl-5-phenylpentanol, 2-methyl-5-(2,3-dimethyltricyclo[2.2.1.0(2,6)]hept-3-yl)-2-penten-1-ol (santalol), 4-methyl-1-phenyl-2-pentaol, (1-methyl-bicyclo[2.1.1]hepten-2-yl)-2-methylpent-1-en-3-ol, 3-methyl-1-phenylpentan-3-ol, 1,2-dimethyl-3-(1-methylethenyl)cyclopentan-1-ol, 2-isopropyl-5-methyl-2-hexenol, cis-3-hexen-1-ol, trans-2-hexen-1-ol, 2-isoproenyl-4-methyl-4-hexen-1-ol (Lavandulol), 2-ethyl-2-prenyl-3-hexenol, 1-hydroxymethyl-4-iso-propenyl-1-cyclohexene (Dihydrocuminyl alcohol), 1-methyl-4-isopropenylcyclohex-6-en-2-ol (carvenol), 6-methyl-3-isopropenylcyclohexan-1-ol, 1-methyl-4-isopropenylcyclohexan-3-ol, 4-isopropyl-1-methylcyclohexan-3-ol, 4-tert-butylcyclo-hexanol, 2-tert-butylcyclohexanol, 2-tert-butyl-4-methylcyclohexanol, 4-isopropyl-cyclohexanol, 4methyl-1-(1-methylethyl)3-cyclohexen-1-ol, 2-(5,6,6-trimethyl-2-norbomyl)cyclohexanol, isobornylcyclohexyl, 3,3,5-trimethylcyclohexanol, 1-methyl-4-isopropylcyclohexan-3-ol, 1,2-dimethyl-3-(1-methylethyl)cyclohexan-1-ol, heptanol, 2,4-dimethylheptan-1-ol, 2,4-dimethyl-2,6-heptandienol, 6,6-dimethyl-2-oxymethylbicyclo[3.1.1]hept-2-ene (myrtenol), 4-methyl-2,4-heptadien-1-ol, 3,4,5,6,6-pentamethyl-2-heptanol, 3,6-dimethyl-3-vinyl-5-hepten-2-ol, 6,6-dimethyl-3-hydroxy-2-methylenebicyclo[3.1.1]heptane, 1,7,7-trimethylbicyclo[2.2.1]heptan-2-ol, 2,6-dimethylheptan-2-ol, 2,6,6-trimethylbicyclo[1.3.3]heptan-2-ol, octanol, 2-octenol, 2-methyloctan-2-ol, 2-methyl-6-methylene-7-octen-2-ol (myrcenol), 7-methyloctan-1-ol, 3,7-dimethyl-6-octenol, 3,7-dimethyl-7-octenol, 3,7-dimethyl-6-octen- 1-ol (citronellol), 3,7-dimethyl-2,6-octadien-1-ol (geraniol), 3,7-dimethyl-2,6-octadien-1-ol (nerol), 3,7-dimethyl-1,6-octadien-3-ol (linalool), 3,7-dimethyloctan-1-ol (pelagrol), 3,7-dimethyloctan-3-ol (tetrahydrolinalool), 2,4-octadien-1-ol, 3,7-dimethyl-6-octen-3-ol, 2,6-dimethyl-7-octen-2-ol, 2,6-dimethyl-5,7-octadien-2-ol, 4,7-dimethyl-4-vinyl-6-octen-3-ol, 3-methyloctan-3-ol, 2,6-dimethyloctan-2-ol, 2,6-dimethyloctan-3-ol, 3,6-dimethyloctan-3-ol, 2,6-dimethyl-7-octen-2-ol, 2,6-dimethyl-3,5-octadien-2-ol (muguol), 3-methyl-1-octen-3-ol, 7-hydroxy-3,7-dimethyloctanal, 3-nonanol, 2,6-nonadien-1-ol, cis-6-nonen-1-ol, 6,8-dimethylnonan-2-ol, 3-(hydroxymethyl)-2-nonanone, 2-nonen- 1 -ol, 2,4-nonadien-1-ol, 3,7-dimethyl-1,6-nonadien-3-ol, decanol, 9-decenol, 2-benzyl-M-dioxa-5-ol, 2-decen-1-ol, 2,4-decadien-1-ol, 4-methyl-3-decen-5-ol, 3,7,9-trimethyl-1,6-decadien-3-ol (isobutyl linalool), undecanol, 2-undecen-1-ol, 10-undecen-1-ol, 2-dodecen-1-ol, 2,-dodecadien-1-ol, 2,7,11-trimethyl-2,6,10-dodecatrien-1-ol (farnesol), 3,7,11-trimetyl-1,6,10,-dodecatrien-3-ol, 3,7,11,15-tetramethylhexadec-2-en-1-ol (phytol), 3,7,11,5-tetramethylhexadec-1-en-3-ol (iso phytol), benzyl alcohol, p-methoxy benzyl alcohol (anisyl alcohol), para-cymen-7-ol (cuminyl alcohol), 4-methyl benzyl alcohol, 3,4-methylenedioxy benzyl alcohol, methyl salicylate, benzyl salicylate, cis-3-hexenyl salicylate, n-pentyl salicylate, 2-phenylethyl salicylate, n-hexyl salicylate, 2-methyl-5-isopropylphenol, 4-ethyl-2-methoxyphenol, 4-allyl-2-methoxyphenol (eugenol), 2-methoxy-4-(1-propenyl)phenol (isoeugenol), 4-allyl-2,6-dimethoxy-phenol, 4-tert-butylphenol, 2-ethoxy-4-methylphenol, 2-methyl-4-vinylphenol, 2-isopropyl-5-methylphenol (thymol), pentyl-ortho-hydroxy benzoate, ethyl 2-hydroxy-benzoate, methyl 2,4-dihydroxy-3,6-dimethylbenzoate, 3-hydroxy-5-methoxy-1-methylbenzene, 2-tert-butyl-4-methyl-1-hydroxybenzene, 1-ethoxy-2-hydroxy-4-propenylbenzene, 4-hydroxytoluene, 4-hydroxy-3-methoxybenzaldehyde, 2-ethoxy-4-hydroxybenzaldehyde, decahydro-2-naphthol, 2,5,5-trimethyl-octahydro-2-naphthol, 1,3,3-trimethyl-2-norbornanol (fenchol), 3a,4,5,6,7,7a-hexahydro-2,4-dimethyl-4,7-methano-1H-inden-5-ol, 3a,4,5,6,7,7a-hexahydro-3,4-dimethyl-4,7-methano-1H-inden-5-ol, 2-methyl-2-vinyl-5-(1-hydroxy-1-methylethyl) tetrahydrofuran, β-caryophyllene alcohol, and mixtures thereof Preferred alcohols which are released by the acetals and ketals of the present invention are 4-(1-methylethyl) cyclohexanemethanol (mayol), 2,4-dimethyl-3-cyclohexen-1-ylmethanol (floralol), 2,4-dimethylcyclohex-1-ylmethanol (dihydrofloralol), 2,4,6-trimethyl-3-cyclohexen-1-ylmethanol (isocyclogeraniol), 2-phenylethanol, 1-($^4$-isopropylcyclohexyl)ethanol (mugetanol), 2-(o-methylphenyl)-ethanol (ortho-hawthanol), 2-(m-methylphenyl)ethanol (meta-hawthanol), 2-(p-methylphenyl)ethanol (para-hawthanol), 2,2-dimethyl-3-(3-methylphenyl)propan- 1-ol (majantol), 3-phenyl-2-propen-1-ol (cinnamic alcohol), 2-methyl-4-(2,2,3-trimethlyl-3-cyclopenten-1-yl)-2-buten-1-ol (santalaire), 3-methyl-5-phenylpentan-1-ol (phenoxanol), 3-methyl-5-(2,2,3-trimethyl-3-cyclopenten-1-yl)-4-penten-2-ol (ebanol), 2-methyl-4-phenylpentan-1-ol (pamplefleur), cis-3-hexen-1-ol, 3,7-dimethyl-6-octen-1-ol (citronellol), 3,7-dimethyl-2,6-octadien-1-ol (geraniol, nerol or mixtures thereof), 7-methoxy-3,7-dimethyloctan-2-ol (osyrol), 6,8-dimethylnonan-2-ol,cis-6-nonen-1-ol,2,6-nonadien-1-ol, 4-methyl-3-decen-5-ol (undecavertol), benzyl alcohol, 2-methoxy-4-(1-propenyl)phenol (isoeugenol), 2-methoxy-4-(2-propenyl)phenol (eugenol), 4-hydroxy-3-methoxybenzaldehyde (vanillin), and mixtures thereof.

Nonlimiting examples of acetals and ketals which are suitable for use in the rinse added fabric softening compositions of the present invention are digeranyl citral acetal; di(dodecyl) citral acetal; digeranyl vanillin acetal; didecyl hexyl cinnamaldehyde acetal; didecyl ethyl citral acetal; di(dodecyl) ethyl citral; didecyl anisaldehyde acetal; diphenylethyl) ethyl vanillin acetal; digeranyl p-t-bucinal acetal; didecyl tacetal; cetal; di(dodecyl) triplal acetal; digeranyl decanal acetal; di(dodecyl) decanal acetal; dicitronellyl lauryl acetal; di(tetradecyl) lauryl acetal; di(octadecyl) helional acetal; di(phenylethyl) citronellal acetal; di(3-methyl-5-phenyl pentanol) citronellal acetal; diphenylhexyl)

isocitral acetal; di(phenylethyl) floralozone acetal; didodecyl floralozone acetal; di(2-ethylhexyl) octanal acetal; di (9-decen-1-yl)p-t-bucinal acetal; di(cis-3-hexenyl) methyl nonyl acetaldehyde acetal and di(phenylethyl) p-t bucinal acetal.

The compositions of the present invention comprise two essential elements, pro-fragrance or pro-accord acetal or ketal ingredients, and ingredients useful for formulating fabric softening compositions.

Fabric Softening Ingredients

The preferred fabric softening agents which comprise the rinse added fabric softening compositions of the present invention have the formula:

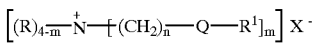

or the formula:

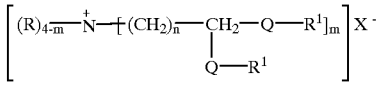

wherein Q is a carbonyl unit having the formula:

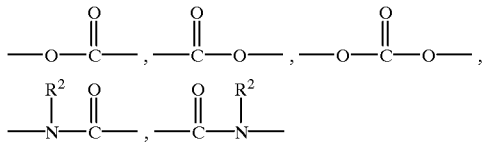

each R unit is independently hydrogen, $C_1$–$C_6$ alkyl, $C_1$–$C_6$ hydroxyalkyl, and mixtures thereof; each $R^1$ unit is independently linear or branched $C_{11}$–$C_{22}$ alkyl, linear or branched $C_{11}$–$C_{22}$ alkenyl, and mixtures thereof, $R^2$ is hydrogen, $C_1$–$C_4$ alkyl, $C_1$–$C_4$ hydroxyalkyl, and mixtures thereof; X is a cation which is compatible with fabric softener actives and adjunct ingredients; the index m is from 1 to 4; the index n is from 1 to 4.

An example of a preferred fabric softener active is a mixture of quaternized amines having the formula:

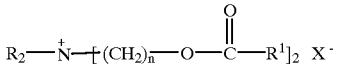

wherein R is preferably methyl; $R^1$ is a linear or branched alkyl or alkenyl chain comprising at least 11 atoms, preferably at least 16 atoms. In the above fabric softener example, the unit $—O_2CR^1$ represents a fatty acyl unit which is typically derived from a triglyceride source. The triglyceride source is preferably derived from tallow, partially hydrogenated tallow, lard, partially hydrogenated lard, vegetable oils and/or partially hydrogenated vegetable oils, such as, canola oil, safflower oil, peanut oil, sunflower oil, corn oil, soybean oil, tall oil, rice bran oil, etc. and mixtures of these oils.

The preferred fabric softening actives of the present invention are the Diester and/or Diamide Quaternary Ammonium (DEQA) compounds, the diesters and diamides having the formula:

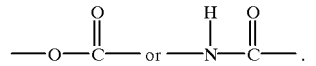

wherein R, $R^1$, X, and n are the same as defined herein above and Q has the formula:

These preferred fabric softening actives are formed from the reaction of an amine with a fatty acyl unit to form an amine intermediate having the formula:

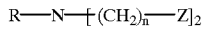

wherein R is preferably methyl, Z is —OH, $—NH_2$, or mixtures thereof; followed by quaternization to the final softener active.

Non-limiting examples of preferred amines which are used to form the DEQA fabric softening actives according to the present invention include methyl bis(2-hydroxyethyl) amine having the formula:

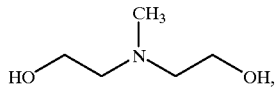

methyl bis(2-hydroxypropyl)amine having the formula:

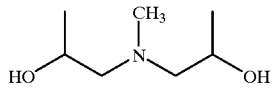

methyl (3-aminopropyl) (2-hydroxyethyi)amine having the formula:

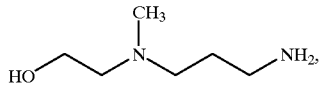

and methyl bis(2-aminoethyl)amine having the formula:

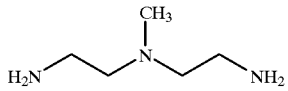

The counterion, $X^{(-)}$ above, can be any softener-compatible anion, preferably the anion of a strong acid, for example, chloride, bromide, methylsulfate, ethylsulfate, sulfate, nitrate and the like, more preferably chloride. The anion can also, but less preferably, carry a double charge in which case $X^{(-)}$ represents half a group.

Tallow and canola are convenient and inexpensive sources of fatty acyl units which are suitable for use in the present invention as $R^1$ units. The following are non-limiting examples of quaternary ammonium compounds suitable for use in the compositions of the present invention. The term "tallowyl" as used herein below indicates the $R^1$ unit is derived from a tallow triglyceride source and is a mixture of fatty acyl units. Likewise, the use of the term canolyl refers to a mixture of fatty acyl units derived from canola oil.

| Fabric Softener Actives |
| --- |
| N,N-di(tallowyl-oxy-ethyl)-N,N-dimethyl ammonium chloride; |
| N,N-di(canolyl-oxy-ethyl)-N,N-dimethyl ammonium chloride; |
| N,N-di(tallowyl-oxy-ethyl)-N-methyl, N-(2-hydroxyethyl) ammonium chloride; |
| N,N-di(canolyl-oxy-ethyl)-N-methyl, N-(2-hydroxyethyl) ammonium chloride; |
| N,N-di(2-tallowyloxy-2-oxo-ethyl)-N,N-dimethyl ammonium chloride; |
| N,N-di(2-canolyloxy-2-oxo-ethyl)-N,N-dimethyl ammonium chloride |
| N,N-di(2-tallowyloxyethylcarbonyloxyethyl)-N,N-dimethyl ammonium chloride; |
| N,N-di(2-canolyloxyethylcarbonyloxyethyl)-N,N-dimethyl ammonium chloride; |
| N-(2-tallowoyloxy-2-ethyl)-N-(2-tallowyloxy-2-oxo-ethyl)-N,N-dimethyl ammonium chloride; |
| N-(2-canolyloxy-2-ethyl)-N-(2-canolyloxy-2-oxo-ethyl)-N,N-dimethyl ammonium chloride; |
| N,N,N-tri(tallowyl-oxy-ethyl)-N-methyl ammonium chloride; |
| N,N,N-tricanolyl-oxy-ethyl)-N-methyl ammonium chloride; |
| N-(2-tallowyloxy-2-oxoethyl)-N-(tallowyl)-N,N-dimethyl ammonium chloride; |
| N-(2-canolyloxy-2-oxoethyl)-N-(canolyl)-N,N-dimethyl ammonium chloride; |
| 1,2-ditallowyloxy-3-N,N,N-trimethylammoniopropane chloride; and |
| 1,2-dicanolyloxy-3-N,N,N-trimethylammoniopropane chloride; |
| and mixtures of the above actives. |

Particularly preferred is N,N-di(tallowoyl-oxy-ethyl)-N, N-dimethyl ammonium chloride, where the tallow chains are at least partially unsaturated.

The level of unsaturation contained within the tallow, canola, or other fatty acyl unit chain can be measured by the Iodine Value (IV) of the corresponding fatty acid, which in the present case should preferably be in the range of from 5 to 100 with two categories of compounds being distinguished, having a IV below or above 25.

Indeed, for compounds having the formula:

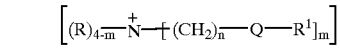

derived from tallow fatty acids, when the Iodine Value is from 5 to 25, preferably 15 to 20, it has been found that a cis/trans isomer weight ratio greater than about 30/70, preferably greater than about 50/50 and more preferably greater than about 70/30 provides optimal concentrability.

For compounds of this type made from tallow fatty acids having a Iodine Value of above 25, the ratio of cis to trans isomers has been found to be less critical unless very high concentrations are needed.

Other suitable examples of fabric softener actives are derived from fatty acyl groups wherein the terms "tallowyl" and canolyl" in the above examples are replaced by the terms "cocoyl, palmyl, lauryl, oleyl, ricinoleyl, stearyl, palmityl," which correspond to the triglyceride source from which the fatty acyl units are derived. These alternative fatty acyl sources can comprise either fully saturated, or preferably at least partly unsaturated chains.

As described herein before, R units are preferably methyl, however, suitable fabric softener actives are described by replacing the term "methyl" in the above examples in Table II with the units "ethyl, ethoxy, propyl, propoxy, isopropyl, butyl, isobutyl and t-butyl.

The counter ion, X, in the examples of Table II can be suitably replaced by bromide, methylsulfate, formate, sulfate, nitrate, and mixtures thereof. In fact, the anion, X, is merely present as a counterion of the positively charged quaternary ammonium compounds. The nature of the counterion is not critical at all to the practice of the present invention. The scope of this invention is not considered limited to any particular anion.

The quaternary ammonium or their non-quaternized amine precursor compounds are present at levels of from about 1% to about 80% of compositions herein, depending on the composition execution which can be dilute with a preferred level of active from about 5% to about 15%, or concentrated, with a preferred level of active from about 15% to about 50%, most preferably about 15% to about 35%.

For the preceding fabric softening agents, the pH of the compositions herein is an important parameter of the present invention. Indeed, it influences the stability of the quaternary ammonium or amine precursors compounds, especially in prolonged storage conditions.

The pH, as defined in the present context, is measured in the neat compositions at 20° C. While these compositions are operable at pH of less than about 8.0, for optimum hydrolytic stability of these compositions, the neat pH, measured in the above-mentioned conditions, must be in the range of from about 2.0 to about 4.5, preferably about 2.0 to about 3.5. The pH of these compositions herein can be regulated by the addition of a Bronsted acid.

Examples of suitable acids include the inorganic mineral acids, carboxylic acids, in particular the low molecular weight ($C_1$–$C_5$) carboxylic acids, and allylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Additional Softening Agents

Softening agents which are also usefull in the compositions of the present invention are nonionic fabric softener materials, preferably in combination with cationic softening agents. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from about 0.1% to about 10%, preferably from about 1% to about 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentarytiritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid, oleic and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include monoesters with stearic, oleic, lalmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Additional fabric softening agents usefull herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. Nos.: 3,861,870, Edwards and Diehl; 4,308,151, Cambre; 3,886,075, Bernardino; 4,233,164, Davis; 4,401,578, Verbruggen; 3,974,076, Wiersema and Rieke; 4,237,016, Rudkin, Clint, and Young; and European Patent Application publication No. 472,178, by Yamamura et al., all of said documents being incorporated herein by reference.

For the purposes of the present invention, the further suitable softening agents which are useful for inclusion in the rinse added fabric softening compositions of the present invention can be broadly classified into one of three general categories:

(a) the reaction product of higher fatty acids with a polyamine selected from the group consisting of hydroxyalkylalkylenediamines and dialkylenetriamines and mixtures thereof (preferably from about 10% to about 80%); and/or (b) cationic nitrogenous salts containing only one long chain acyclic aliphatic $C_{15}$–$C_{22}$ hydrocarbon group (preferably from about 3% to about 40%); and/or (c) cationic nitrogenous salts having two or more long chain acyclic aliphatic $C_{15}$–$C_{22}$ hydrocarbon groups or one said group and an arylalkyl group (preferably from about 10% to about 80%);

with said (a), (b) and (c) preferred percentages being by weight of the fabric softening agent component of the present invention compositions.

Following are the general descriptions of the preceding (a), (b), and (c) softener ingredients (including certain specific examples which illustrate, but do not limit the present invention).

Component (a)

Softening agents (actives) of the present invention may be the reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (a) is a nitrogenous compound selected from the group consisting of the reaction product mixtures or some selected components of the mixtures. More specifically, the preferred Component (a) is a compound selected from the group consisting of substituted imidazoline compounds having the formula:

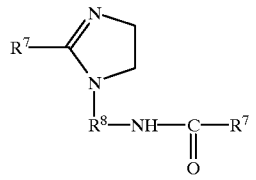

wherein $R^7$ is an acyclic aliphatic $C_{15}$–$C_{21}$ hydrocarbon group and $R^8$ is a divalent $C_1$–$C_3$ alkylene group.

Component (a) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyldiethylenetriamine; 1-tallowamidoethyl-2-tallowimidazoline (wherein in the preceding structure $R^1$ is an aliphatic $C_{15}$–$C_{17}$ hydrocarbon group and $R^8$ is a divalent ethylene group).

Certain of the Components (a) can also be first dispersed in a Bronsted acid dispersing aid having a pKa value of not greater than about 4; provided that the pH of the final composition is not greater than about 6. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varsoft® 475.

Component (b)

The preferred, Component (b) is a cationic nitrogenous salt containing one long chain acyclic aliphatic $C_{15}$–$C_{22}$ hydrocarbon group, preferably selected from acyclic quaternary ammonium salts having the formula:

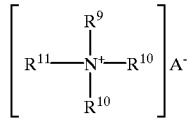

wherein $R^9$ is an acyclic aliphatic $C_{15}$–$C_{22}$ hydrocarbon group, $R^{10}$ and $R^{11}$ are $C_1$–$C_4$ saturated alkyl or hydroxy alkyl groups, and A- is an anion.

Examples of Component (b) are the monoalkyltrimethylammonium salts such as monoalkyltrimethylammonium chloride, mono(hydrogenated tallow)trimethylammonium chloride, palmityltrimethyl ammonium chloride and soyatrimethylammonium chloride, sold by Witco Chemical Company under the trade name Adogen® 471, Adogen) 441, Adogen® 444, and Adogen® 415, respectively. In these salts, $R^9$ is an acyclic aliphatic $C_{16}$–$C_{18}$ hydrocarbon group, and $R^{10}$ and $R^{11}$ are methyl groups. Mono(hydrogenated tallow)trimethylammonium chloride and monotallowtrimethylammonium chloride are preferred.

Other examples of Component (b) are behenyltrimethylammonium chloride wherein $R^9$ is a $C_{22}$ hydrocarbon group and sold under the trade name Kemamine® Q2803-C by Humko Chemical Division of Witco Chemical Corporation; soyadimethylethylammonium ethylsulfate wherein $R^9$ is a $C_{16}$–$C_{18}$ hydrocarbon group, $R^{10}$ is a methyl group, $R^{11}$ is an ethyl group, and A- is an ethylsulfate anion, sold under the trade name Jordaquat® 1033 by Jordan Chemical Company; and methyl-bis(2-hydroxyethyl)-octadecylammonium chloride wherein $R^9$ is a $C^{18}$ hydrocarbon group, $R^{10}$ is a 2-hydroxyethyl group and $R^{11}$ is a methyl group and available under the trade name Ethoquad(D 18/12 from Armak Company.

Other examples of Component (b) are 1-ethyl-1-(2-hydroxy ethyl)-2-isoheptadecylimidazolinium ethylsulfate, available from Mona Industries, Inc. under the trade name Monaquat® ISIES; mono(tallowoyloxyethyl) hydroxyethyldimethylammonium chloride, i.e., monoester of tallow fatty acid with di(hydroxyethyl)dimethylammonium chloride, a by-product in the process of making diester of tallow fatty acid with di(hydroxyethyl)dimethylammonium chloride, i.e., di(tallowoyloxyethyl) dimethylammonium chloride.

Component (c)

Preferred cationic nitrogenous salts having two or more long chain acyclic aliphatic $C_{15}$–$C_{22}$ hydrocarbon groups or one said group and an arylalkyl group which can be used either alone or as part of a mixture are selected from the group consisting of:

acyclic quaternary ammonium salts having the formula:

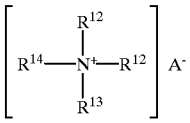

wherein $R^{12}$ is an acyclic aliphatic $C_{15}$–$C_{22}$ hydrocarbon group, $R^{13}$ is a $C_1$–$C_4$ saturated alkyl or hydroxyalkyl group, $R^{14}$ is selected from the group consisting of $R^{12}$ and $R^{13}$ groups, and A- is an anion defined as above.

Examples of Component (c) are the well-known dialkyl dimethylammonium salts such as ditallowdimethylammonium chloride, ditallowdimethylammonium methylsulfate, di(hydrogenatedtallow)dimethylammonium chloride, distearyldimethylammonium chloride, dibehenyldimethylammonium chloride. Di(hydrogenatedtallow)di methylammonium chloride and ditallowdimethylammonium chloride are preferred. Examples of commercially available dialkyldimethyl ammonium salts usable in the present invention are di(hydrogenatedtallow)dimethylammonium chloride (trade name Adogen® 442), ditallowdimethylammonium chloride (trade name Adogen® 470), distearyl dimethylammonium chloride (trade name Arosurf® TA-100), all available from Witco Chemical Company. Dibehenyldimethylammonium chloride is sold under the trade name Kemamine Q-2802C by Humko Chemical Division of Witco Chemical Corporation.

Other examples of Component (c) are methylbis(tallowamidoethyl)(2-hydroxyethyl)ammonium methylsulfate and methylbis(hydrogenated tallowamidoethyl)(2-hydroxyethyl)ammonium methylsulfate; these materials are available from Witco Chemical Company under the trade names Varisoft® 222 and Varisoft® 110, respectively: dimethylstearylbenzyl ammonium chloride sold under the trade names Varisoft® SDC by Witco Chemical Company and Ammonyx® 490 by Onyx Chemical Company.

An even more preferred composition contains Component (a): the reaction product of about 2 moles of hydrogenated tallow fatty acids with about 1 mole of N-2-hydroxyethylethylenediamine and is present at a level of from about 20% to about 70% by weight of the fabric softening component of the present invention compositions; Component (b): mono(hydrogenated tallow)trimethyl ammonium chloride present at a level of from about 3% to about 30% by weight of the fabric softening component of the present invention compositions; Component (c): selected from the group consisting of di(hydrogenatedtallow) dimethylammonium chloride, ditallowdimethylammonium chloride, methyl-1-tallowamidoethyl-2-tallowimidazolinium methylsulfate, diethanol ester dimethylammonium chloride, and mixtures thereof, wherein Component (c) is present at a level of from about 20% to about 60% by weight of the fabric softening component of the present invention compositions; and wherein the weight ratio of said di(hydrogenated tallow)dimethylammonium chloride to said methyl-1-tallowamidoethyl-2-tallowimidazolinium methylsulfate is from about 2:1 to about 6:1.

In the cationic nitrogenous salts described hereinbefore, the anion A-provides charge neutrality. Most often, the anion used to provide charge neutrality in these salts is a halide, such as chloride or bromide. However, other anions can be used, such as methylsulfate, ethylsulfate, hydroxide, acetate, formate, citrate, sulfate, carbonate, and the like. Chloride and methylsulfate are preferred herein as anion A-.

As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

Liquid carrier

Another optional, but preferred, ingredient is a liquid carrier. The liquid carrier employed in the instant compositions is preferably at least primarily water due to its low cost, relative availability, safety, and environmental compatibility. The level of water in the liquid carrier is preferably at least about 50%, most preferably at least about 60%, by weight of the carrier. Mixtures of water and low molecular weight, e.g., <about 200, organic solvent, e.g.,-lower alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Concentration aids

Concentrated compositions of the present invention may require organic and/or inorganic concentration aids to go to even higher concentrations and/or to meet higher stability standards depending on the other ingredients. Surfactant concentration aids are typically selected from the group consisting of single long chain alkyl cationic surfactants; nonionic surfactants; amine oxides; fatty acids; or mixtures thereof, typically used at a level of from 0 to about 15% of the composition.

Inorganic viscosity/dispersibility control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include 1-lysine monohydrochloride and 1,5-diammonium 2-methyl pentane dihydrochloride.

4. Other ingredients

Still other optional ingredients include, but are not limited to Soil Release Agents, perfumes, preservatives/stabilizers, chelants, bacteriocides, colorants, optical brighteners, antifoam agents, and the like.

Soil Release Agents

Soil Release agents are desirably used in fabric softening compositions of the instant invention. Suitable soil release agents include those of U.S. Pat. No. 4,968,451, Nov. 6, 1990 to J. J. Scheibel and E. P. Gosselink: such ester oligomers can be prepared by (a) ethoxylating allyl alcohol, (b) reacting the product of (a) with dimethyl terephthalate ("DMT") and 1,2-propylene glycol ("PG") in a two-stage transesterification/oligomerization procedure and (c) reacting the product of (b) with sodium metabisulfite in water; the nonionic end-capped 1,2-propylene/polyoxyethylene terephthalate polyesters of U.S. Pat. No. 4,711,730, Dec. 8, 1987 to Gosselink et al, for example those produced by transesterification/oligomerization of poly(ethyleneglycol) methyl ether, DMT, PG and poly(ethyleneglycol) ("PEG"); the partly- and fully- anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, Me-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al, the latter being typical of SRA's useful in both laundry and fabric conditioning products, an example being an ester composition made from m-sulfobenzoic acid monosodium salt, PG and DMT optionally but preferably further comprising added PEG, e.g., PEG 3400. Another preferred soil release agent is a sulfonated end-capped type described in U.S. Pat. No. 5,415,867.

Perfumes

While the pro-fragrances of the present invention can be used alone and simply mixed with essential fabric softening ingredient, most notably surfactant, they can also be desirably combined into three-part formulations which combine (a) a non-fragranced fabric softening base comprising one or more synthetic fabric softeners, (b) one or more pro-fragrant P-keto-esters in accordance with the invention and (c) a fully-formulated fragrance. The latter provides desirable in-package and in-use (wash-time) fragrance, while the pro-fragrance provides a long-term fragrance to the laundered textile fabrics.

In formulating the present fabric softening compositions, the fully-formulated fragrance can be prepared using numerous known odorant ingredients of natural or synthetic origin. The range of the natural raw substances can embrace not only readily-volatile, but also moderately-volatile and slightly-volatile components and that of the synthetics can include representatives from practically all classes of fragrant substances, as will be evident from the following illustrative compilation: natural products, such as tree moss absolute, basil oil, citrus fruit oils (such as bergamot oil, mandarin oil, etc.), mastix absolute, myrtle oil, palmarosa oil, patchouli oil, petitgrain oil Paraguay, wormwood oil, alcohols, such as farnesol, geraniol, linalool, nerol, phenylethyl alcohol, rhodinol, cinnamic alcohol, aldehydes, such as citral, Helional™, alpha-hexyl-cinnamaldehyde, hydroxycitronellal, Lilial™ (p-tert-butyl-alpha-methyldihydrocinnamaldehyde), methylnonylacetaldehyde, ketones, such as allylionone, alpha-ionone, beta-ionone, isoraldein (isomethyl-alpha-ionone), methylionone, esters, such as allyl phenoxyacetate, benzyl salicylate, cinnamyl propionate, citronellyl acetate, citronellyl ethoxolate, decyl acetate, dimethylbenzylcarbinyl acetate, dimethylbenzylcarbinyl butyrate, ethyl acetoacetate, ethyl acetylacetate, hexenyl isobutyrate, linalyl acetate, methyl dihydrojasmonate, styrallyl acetate, vetiveryl acetate, etc., lactones, such as gamma-undecalactone, various components often used in perfumery, such as musk ketone, indole, p-menthane-8-thiol-3-one, and methyl-eugenol. Likewise, any conventional fragrant acetal or ketal known in the art can be added to the present composition as an optional component of the conventionally formulated perfume (c). Such conventional fragrant acetals and ketals include the well-known methyl and ethyl acetals and ketals, as well as acetals or ketals based on benzaldehyde, those comprising phenylethyl moieties, or more recently developed specialties such as those described in a United States Patent entitled "Acetals and Ketals of Oxo-Tetralins and Oxo-Indanes, see U.S. Pat. No. 5,084,440; issued Jan. 28, 1992, assigned to Givaudan Corp. Of course, other recent synthetic specialties can be included in the perfume compositions for fully-formulated fabric softening compositions. These include the enol ethers of alkyl-substituted oxo-tetralins and oxo-indanes as described in U.S. Pat. No. 5,332,725, Jul. 26, 1994, assigned to Givaudan; or Schiff Bases as described in U.S. Pat. No. 5,264,615, Dec. 9, 1991, assigned to Givaudan. It is preferred that the pro-fragrant material be added separately from the conventional fragrances to the fabric softening compositions of the invention.

Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. The use of antioxidants and reductive agent stabilizers is especially critical for low scent products (low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171, Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-dihydroxy-m-benzene-sulfonic acid/sodium salt, EDDS, and DTPA®, available from Aldrich with a chemical name of diethylenetriaminepentaacetic acid. The chemical names and CAS numbers for some of the above stabilizers are listed in Table II below.

TABLE II

| Antioxidant | CAS No. | Chemical Name used in Code of Federal Regulations |
|---|---|---|
| Irganox ® 1010 | 6683-19-8 | Tetrakis (methylene(3,5-di-tert-butyl-4 hydroxyhydrocinnamate)) methane |
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydrocinnamamide |
| Irganox ® B 1171 | 31570-04-4<br>23128-74-7 | 1:1 Blend of Irganox ® 1098 and Irgafos ® 168 |
| Irganox ® 1425 | 65140-91-2 | Calcium bis(monoethyl(3,5-di-tert-butyl-4-hydroxybenzyl)phosphonate) |
| Irganox ® 3114 | 65140-91-2 | Calcium bis(monoethyl(3,5-di-tert-butyl-4-hydroxybenzyl)phosphonate) |
| Irganox ® 3125 | 34137-09-2 | 3,5-Di-tert-butyl-4-hydroxy-hydrocinnamic acid triester with 1,3,5-tris(2-hydroxyethyl)-S-triazine-2,4,6-(1H, 3H, 5H)-trione |
| Irgafos ® 168 | 31570-04-4 | Tris(2,4-di-tert-butyl-phenyl)phosphite |

Examples of reductive agents include sodium borohydride, hypophosphorous acid, Irgafos® 168, and mixtures thereof.

The following examples illustrate the β-keto-esters and compositions of this invention, but are not intended to be limiting thereof.

Synthesis of pro-fragrances

Acetals and ketals can be prepared by the acid catalyzed reaction of an aldehyde or ketone with an alcohol (or diol), using conventional acid catalysis such as HCl or p-toluenesulfonic acid, or supported sulfonic acid catalysts e.g., AMBERLYST 15™. See Meskens, F., *Synthesis,* (7) 501 (1981) and Meskens, F., *Jannsen Chim Acta* (1) 10 (1983). Many aldehyde, ketone and alcohols useful in the synthesis of acetal and ketal pro-fragrances of the present invention are sensitive to strong acid conditions and can undergo undesirable side reactions. See Bunton, C. A. et al, *J. Org. Chem.* (44), 3238, (1978), and Cort, O., et al, *J. Org Chem.* (51), 1310 (1986). It is also known that acetals of alpha, beta unsaturated aldehydes can undergo migration of the double bond under the inappropriate selection of the acid catalyst. See Meskens, F., *Synthesis,* (7), 501, (1981) and Lu, T.-J, et al. *J. Org. Chem.* (60), 2931, (1995), Miyashita, M., et al. *J. Org. Chem.* (44), 3772 (1977). For acid sensitive materials, acid catalysts with pKa's between 3 and 4 are the most desirable to minimize double bond migration while maintaining the reactivity necessary to produce the acetal (or ketal). For example, in the synthesis of digeranyl decanal, p-toluenesulfonic acid ($pK_a$=1) causes undesirable side reactions with geraniol. Citric acid ($pK_{a1}$=3.1, $pK_{a2}$=4.8, $pK_{a3}$=6.4) or pyridinium p-toluenesulfonate can be used to form the acetal without side reactions.

Another technique of avoiding side reactions in preparing acetals of acid sensitive materials, such as geraniol, is by transacetalization of a dimethyl acetal with a higher molecular weight alcohol, using a mild Lewis acid such as titanium.

When prepared according to the before mentioned synthetic routes, the acetals of the present invention may also contain minor levels of the corresponding vinyl ether.

EXAMPLE 1

Preparation of di(9-decen-1-yl) p-t-bucinal acetal

9-Decen-1-ol in the amount of 48.55 g (0.311 mol), p-t-Bucinal in the amount of 21.25 g (0.104 mol), pyridinium p-toluenesulfonate in the amount of 1.31 g (5.20 mmol) and benzene in the amount of 200 mL are combined in a 500 mL single-necked round-bottomed flask fitted with a Dean-Stark trap, condenser, argon inlet, and heating mantel. The mixture is brought to reflux. After 18 h, the theoretical amount of water is collected in the Dean-Stark trap. After cooling, the reaction mixture is treated with 5 g of solid sodium carbonate for 2 h and filtered. The solvent is removed under reduced pressure followed by removal of unreacted starting materials via bulb-to-bulb distillation at 65–85° C. (0.2 mm Hg) yielding a yellow oil. The oil is purified by column chromatography (elution with 5% ethyl acetate dissolved in petroleum ether) to give a near colorless oil. Purity of the product is determined by thin layer chromatography and the structure confirmed by mass sectrometry, $^1$H and $^{13}$C NMR.

EXAMPLE 2

Preparation of a p-t-Bucinal acetal blend made from a mixture of β-γ-hexenol, 9-decen-1-ol and phenoxanol p-t-Bucinal in the amount of 161.18 g (0.789 mol), β-γ-hexenol in the amount of 37.95 g (0.379 mol), 9-decen-1-ol in the amount of 187.88 g (1.202 mol), phenoxanol in the amount of 187.88 g (1.05 mol), pyridinium p-toluenesulfonate in the amount of 1.35 g (5.37 mmol) and benzene in the amount of 200 mL are combined in a flask fitted with a condenser, argon inlet and Dean-Stark trap. The mixture is heated to reflux for 48 h at which time the theoretical amount of water is collected. After cooling, the reaction mixture is treated with 2 g of solid sodium methoxide and 5 g solid sodium carbonate. The solvent is removed by rotary evaporation followed by removal of unreacted starting materials via bulb-to-bulb distillation at 80–90° C., 0.05 mm Hg to give an orange/brown mixture. The resulting mixture is taken up in an equal amount of dichloromethane and the resulting solution filtered through a celite plug. The filtrate is concentrated by rotary evaporation to yield a yellow oil. The oil is purified by column chromatography (elution with 5% ethyl acetate dissolved in petroleum ether) to give a near colorless oil. Purity of the product is determined by thin layer chromatography and GC analysis and the structure confirmed by mass spectrometry, $^{1}H$ and $^{13}C$ NMR.

EXAMPLE 3

Preparation of a triplal acetal blend made from a mixture of β-γ-hexenol, 9-decen-1-ol and phenoxanol Triplal in the amount of 100.00 g (0.724 mol), β-γ-hexenol in the amount of 34.84 g (0.348 mol), 9-decen-1-ol in the amount of 172.43 g (1.103 mol), phenoxanol in the amount of 172.43 g (0.967 mol), pyridinium p-toluenesulfonate in the amount of 1.30 g (5.17 mmol) and benzene in the amount of 200 mL are combined in a flask fitted with a condenser, argon inlet and Dean-Stark trap. The mixture is heated to reflux for 48 h at which time the theoretical amount of water is collected. After cooling, the reaction mixture is treated with 2 g of solid sodium methoxide and 5 g of solid sodium carbonate. The solvent is removed by rotary evaporation followed by removal of unreacted starting materials via bulb-to-bulb distillation at 80–90° C., 0.05 mm Hg to give a red/brown mixture. The resulting mixture is taken up in an equal amount of dichloromethane and the resulting solution filtered through a celite plug. The filtrate is concentrated by rotary evaporation to yield a yellow oil. The oil is purified by column chromatography (elution with 5% ethyl acetate dissolved in petroleum ether) to give a near colorless oil. Purity of the product is determined by thin layer chromatography and GC analysis and the structure confirmed by mass spectrometry, $^{1}H$ and $^{13}C$ NMR.

EXAMPLE 4

Preparation of di(β-γ-hexenyl p-t-bucinal acetal p-t-Bucinal in the amount of 44.97 g (0.220 mol), β-γ-hexenol in the amount of 48.48 g (0.484 mol), pyridiniump-toluenesulfonate in the amount of 0.65 g (2.59 mmol) and toluene in the amount of 200 mL are combined in a flask fitted with a condenser, argon inlet and Dean-Stark trap. The mixture is heated to reflux for 24 h at which time the theoretical amount of water is collected. After cooling, the reaction mixture is treated with 1 g of solid sodium methoxide and 3 g of solid sodium carbonate for 2 h and then filtered. The solvent is removed by rotary evaporation followed by removal of unreacted starting materials via bulb-to-bulb distillation at 80–90° C. (0.05 mm Hg) to give an orange/red oil. The oil is purified by column chromatography (elution with 5% ethyl acetate dissolved in petroleum ether) to give a near colorless oil. Purity of the product is determined by thin layer chromlatography and GC analysis and the structure confirmed by mass spectrometry, $^{1}H$ and $^{13}C$ NMR.

EXAMPLE 5

Preparation of a di(β-citronellyl acetal blend of p-t-bucinal, triplal, citral, a-hexylcinnamic aldehyde and decanal p-t-Bucinal in the amount of 4.5 g (0.0220 mol), triplal in the amount of 0.30 g (0.0022 mol), citral in the amount of 0.20 g (0.013 mol), a-hexylcinnamic aldehyde in the amount of 4.5 g (0.0208 mol), decanal in the amount of 0.50 g (0.0032 mol), b-citronellol in the amount of 28.50 g (0.173 mol), p-toluenesulfonic acid in the amount of 0.10 g (5.0 mmol) and toluene in the amount of 70 mL are combined in a flask fitted with a condenser, argon inlet and Dean-Stark trap. The mixture is heated to reflux for 6 h at which time the theoretical amount of water is collected. After cooling, the reaction mixture is treated with 2 g of solid sodium carbonate for 30 minutes and filtered. The solvent is removed by rotary evaporation followed by removal of unreacted starting materials via bulb-to-bulb distillation at 80–90° C,, 0.05 mm Hg to give a yellow/red liquid. The liquid is purified by column chromatography (elution with 1% ethyl acetate dissolved in petroleum ether) to give oil. Purity of the product is determined by thin layer chromatography and GC analysis and the structure confirmed by $^{1}H$ and $^{13}C$ NMR.

EXAMPLE 6

Preparation of didodecyl floralozone acetal

Floralozone in the amount of 10.00 g (0.053 mol), dodecanol in the amount of 21.32 g (0.116 mol), p-toluenesulfonic acid in the amount of 0.50 g (2.63 mmol) and toluene in the amount of 75 mL are combined in a flask fitted with a condenser, argon inlet and Dean-Stark trap. The mixture is heated to reflux for 24 h. After cooling, the reaction mixture is treated with 1 g of solid sodium methoxide and 1 g of solid sodium carbonate for 2 h and then filtered. The solvent is removed by rotary evaporation followed by removal of unreacted starting materials via bulb-to-bulb distillation at 80–90° C. (0.05 mm Hg) to give an orange/red oil. The oil is purified by column chromatography (elution with 5% ethyl acetate dissolved in petroleum ether). Purity of the product is determined by thin layer chromatography and GC analysis and the structure confirmed by $^{1}H$ and $^{13}C$ NMR. Examples of Liquid Fabric Softener Compositions Containing Acetal Pro-perfumes Formulation Example:

| Ingredient | A Wt. % | B Wt. % | C Wt. % | D Wt. % | E Wt. % | F Wt. % |
|---|---|---|---|---|---|---|
| DEQA (1) | 25.0 | 23.3 | 23.3 | 25.0 | 23.3 | 25.0 |
| Ethanol | 4.0 | 3.65 | 3.65 | 4.0 | 3.65 | 4.0 |
| HCl | 0.01 | 0.74 | 0.74 | 0.01 | 0.74 | 0.01 |
| Chelant (2) | — | 2.50 | 2.50 | — | 2.50 | — |
| Ammonium Chloride | — | 0.10 | 0.10 | — | 0.10 | — |
| $CaCl_2$ | 0.46 | 0.50 | 0.50 | 0.46 | 0.50 | 0.46 |
| Silicone Antifoam (3) | 0.15 | 0.15 | 0.15 | 0.15 | 0.15 | 0.15 |
| Preservative (4) | 0.0003 | 0.0003 | 0.0003 | 0.0003 | 0.0003 | 0.0003 |
| Perfume | — | — | 1.35 | 1.20 | 1.00 | 1.28 |
| Soil Release Polymer (5) | 0.50 | 0.75 | 0.75 | 0.50 | 0.75 | 0.75 |
| Product of Example 1 (6) | 0.50 | — | — | — | — | — |
| Product of | — | 0.42 | — | — | — | — |

-continued

| Ingredient | A Wt. % | B Wt. % | C Wt. % | D Wt. % | E Wt. % | F Wt. % |
|---|---|---|---|---|---|---|
| Example 2 (7) | | | | | | |
| Product of Example 3 (8) | — | — | 0.42 | — | — | — |
| Product of Example 4 (9) | — | — | — | 0.80 | — | — |
| Product of Example 5 (10) | — | — | — | — | 0.42 | — |
| Product of Example 6 (11) | — | — | — | — | — | 0.50 |
| Water | 69.38 | 67.89 | 66.54 | 67.88 | 66.89 | 67.85 |

(1) Di-(soft-tallowyloxyethyl) dimethyl ammonium chloride
(2) Diethylenetriamine Pentaacetic acid
(3) DC-2310, sold by Dow-Corning
(4) Kathon CG, sold by Rohm & Haas
(5) Copolymer of propylene terephthalate and ethyleneoxide
(6) Di(9-decen- 1 -yl) p-t-bucinal acetal
(7) p-t-bucinal acetal blend made from a mixture of β-γ-hexenol, 9-decen-1-ol and phenoxanol
(8) Triplal acetal blend made from a mixture of β-γ-hexenol, 9-decen-1-ol and phenoxanol
(9) Di(β-γ-hexenyl) p-t-bucinal acetal
(10) Di(β-citronellyl) acetal blend of p-t-bucinal, citral, α-hexycinnamic aldehyde and decanal
(11) Didodecyl floralozone acetal Process: Example A is made in the following manner: A blend of 250 g DEQA(1) and 40 g ethanol are melted at about 70° C. A 25% aqueous solution of HCl in the amount of 40 g is added to about 675 g of deionized water also at 70° C. containing the antifoam. The DEQA/alcohol blend is added to the water/HCl over a period of about five minutes with very vigorous agitation (IKA Paddle Mixer, model RW 20 DZM at 1500 rpm). A 25% aqueous solution of $CaCl_2$ in the amount of 13.8 g is added to the dispersion dropwise over 1 minute, followed by milling with an IKA Ultra Turrax T-50 high shear mill for 5 minutes. The dispersion is then cooled to room temperature by passing it through a plate and frame heat exchanger. Following cool-down, the soil release polymer is added into the dispersion in the form of a 40% solution and stirred for 10 minutes. The product of Example 1 (6) in the amount of 5.0 g is blended into the dispersion with moderate agitation. Finally, another 4.6 g of 25% $CaCl_2$ is mixed into the dispersion and stirred for several hours.

Examples D and F are made in a like manner, excepting that the pro-perfume material is blended with the perfume component and the resulting mixture is added to the cooled product.

Example B is made in the following manner: A blend of 233 g DEQA(l) and 36.5 g ethanol are melted at about 75° C. A 25% aqueous solution of HCl in the amount of 0.3 g is added to about 670 g of deionized water also at 75° C. containing the antifoam. The DEQA/alcohol blend is added to the water/HCI over a period of about two minutes with very vigorous agitation (IKA Padel Mixer, model RW 20 DZM at 1500 rpm). A 2.5% aqueous solution of $CaCl_2$ in the amount of 2.5 g is added to the dispersion dropwise over 5 minutes, Meanwhile, 61 g of a 41% aqueous solution of the chelant is acidified by the addition of a 25% solution of HCl to a measured pH of 3. A small amount, about 8 g, of the acidified chelant solution is stirred into the dispersion, followed by milling with an IKA Ultra Turrax T-50 high shear mill for 5 minutes. The dispersion is then cooled to room temperature. Following cool-down, the soil release polymer is added into the dispersion in the form of a 40% solution and stirred for 10 minutes. The remaining acidified chelant solution is added over 3 minutes. The product of Example 2 (7) in the amount of 4.2 g is added followed by the addition of ammonium chloride in the form of a 20% aqueous solution. Finally, the remaining $CaCl_2$ is added in the form of a 25% solution.

Examples C and E are made in a like manner, excepting that the pro-perfume material is blended with the perfume component and the resulting mixture is added to the cooled product.

Additional Formulation Examples:

| Ingredient | G Wt. % | H Wt. % | I Wt. % |
|---|---|---|---|
| DEQA (1) | 19.2 | 18.2 | 19.2 |
| Isopropyl alcohol | 3.1 | 2.9 | 3.1 |
| Tallow Alcohol Ethoxylate-25 | — | 1.20 | — |
| Poly(glycerol monostearate) | — | 2.40 | — |
| HCl | 0.02 | 0.08 | 0.02 |
| $CaCl_2$ | 0.12 | 0.18 | 0.12 |
| Silicone Antifoam | 0.02 | 0.02 | 0.02 |
| Soil Release Polymer (5) | 0.19 | 0.19 | 0.19 |
| Poly(ethyleneglycol) 4000 MW | 0.60 | 0.60 | 0.60 |
| Perfume | 0.70 | 0.70 | 0.40 |
| Product of Example 2 (7) | 0.42 | — | — |
| Product of Example 3 (8) | — | 0.42 | — |
| Product of Example 5 (10) | — | — | 0.86 |
| Water | 75.63 | 73.11 | 75.49 |

(1) Di-(hardtallowyloxyethyl) dimethyl ammonium chloride
(5) Copolymer of propylene terephthalate and ethyleneoxide
(7) p-t-Bucinal acetal blend made from a mixture of β-γ-hexenol, 9-decen-1-ol and phenoxanol
(8) Triplal acetal blend made from a mixture of β-γ-hexenol, 9-decen-1-ol and phenoxanol
(10) Di(β-citronellyl) acetal blend of p-t-bucinal, citral, α-hexycinnamic aldehyde and decanal Additional Examples of Liquid Fabric Softener Compositions Containing Pro-perfumes

| Formulation Example: | J | K | L |
|---|---|---|---|
| Ingredient | Wt. % | Wt. % | Wt. % |
| DEQA (1) | 10.35 | 10.35 | 10.35 |
| Ethanol | 1.40 | 1.40 | 1.40 |
| HCl | 0.0219 | 0.0219 | 0.0219 |
| Blue Dye | 0.0045 | 0.0045 | 0.0045 |
| Silicone Antifoam (2) | 0.015 | 0.015 | 0.015 |
| Low Salt Kathon (3) | 0.02 | 0.02 | 0.02 |
| $CaCl_2$ | * | * | * |
| Product of Example 1 (6) | 0.42 | — | — |
| Product of Example 2 (7) | — | 0.42 | — |
| Product of Example 4 (9) | — | — | 0.75 |
| Water | 87.76 | 87.76 | 87.43 |

*Added as needed to adjust viscosity
(1)Di-(hardtallowyioxyethyl) dimethyl ammonium chloride
(2)Silicone DC-2310, sold by Dow-Corning
(3)Kathon CG, sold by Rohm & Haas
(6)Di(9-decen-1-yl) p-t-bucinal acetal
(7)p-t.-Bucinal acetal blend made from a mixture of β-γ-hexenol, 9-decen-1-ol and phenoxanol
(9)Di(β-γ-hexenyl) p-t-bucinal acetal M. Experimental Procedure:

A batch process is used. The procedure is divided in two parts: the preparation of the base product (prepared in the lab. without perfume and technology) and the addition of the perfume and the technology(ies).

Base product (to prepare a batch of 17 kg of base)

A. The main tank is loaded with the water needed (15.1 kg) and is heated to 43° C . Start agitation at 800 rpm and mix blue dye. The mixer used is a Lightnin model LIU08.

B. Add HCl (3.8 g) by hand (31% activity).

C. Preheat DEQA (1)/ethanol at 75° C. (1760 g at 85% actives level) and inject into tank with water at a rate of 22 ml/min.

D. Manually add low salt Kathon (3.4 g) and silicone antifoam (25.7 g).

E. Mix about 5 minutes

Finished product preparation (to prepare 0.250 kg of finished product composition)

F. The product of example 1(1.050 g) is added to a 249 g aliquot of the above product by mixing with an IKA Ultra Turrax T-50 at 6000 rpm for 15 minutes.

Examples K and L are made in a like manner, except that the pro-perfume material is added at the required amount.

Stability of pro-fragrant acetal compositions in acidic media

Acetals are generally considered to be unstable with respect to hydrolysis under acidic conditions. For example, when the acetal prepared according to Example 2 was dissolved in a 90:10 dioxane:water mixture (the hydrophobic acetal is not soluble in water alone) at a nominal pH of 3, only 50% of the material remained intact (i.e. not hydrolyzed) after 7 days at room temperature.

When the same acetal was formulated into a Liquid Fabric Conditioner (see Formulation Example G) which had a nominal pH 3, the following recovery data were obtained:

95% of acetal recovered (i.e. not hydrolyzed) after 4 weeks at room temp.

91% of acetal recovered (i.e. not hydrolyzed) after 4 weeks at 100° F. (38° C.).

These data clearly show that the acetal is markedly and surprisingly more stable in the Liquid Fabric Conditioner matrix than it is in solution.

What is claimed is:

1. A rinse added fabric softening composition comprising:

a) from 0.01% to 15% of an acetal or ketal having the formula:

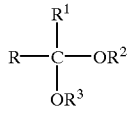

wherein R is $C_3$–$C_{20}$ linear alkyl, $C_4$–$C_{20}$ branched alkyl, $C_6$–$C_{20}$ cyclic alkyl, $C_6$–$C_{20}$ branched cyclic alkyl, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ substituted or unsubstituted aryl, and mixtures thereof; $R_1$ is hydrogen or R; $R^2$ and $R^3$ are each independently selected from the group consisting of $C_5$–$C_{20}$ linear alkyl, $C_4$–$C_{20}$ branched alkyl, $C_6$–$C_{20}$ cyclic alkyl, $C_6$–$C_{20}$ branched cyclic alkyl, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ aryl, $C_7$–$C_{20}$ substituted aryl, and mixtures thereof; provided each acetal or ketal:

i) is formed from at least one fragrance raw material having a molecular weight greater than or equal to about 100 g/mol;

ii) has a molecular weight greater than or equal to about 300 g/mol;

iii) has a molecular weight at least two times greater than the lowest molecular weight fragrance raw material which comprises said acetal or ketal; and b) from 85% to 99.99%, by weight of the composition, of adjunct ingredients, said adjunct ingredients selected from the group consisting of fabric softening actives, liquid carriers, concentration aids, soil release agents, perfumes, preservatives, stabilizers, chelants, bacteriocides, colorants, optical brighteners, antifoam agents, and mixtures thereof;

wherein said compositions have a neat pH of less than 6 at 20° C.

2. A composition according to claim 1 wherein said acetal or ketal comprises at least one —$OR^2$ or —$OR^3$ moiety which is derived from a fragrance raw material alcohol having the formula:

$R^2OH$ or $R^3OH$.

3. A composition according to claim 2 wherein said acetal or ketal comprises at least one —$OR^2$ or —$OR^3$ moiety which is derived from a fragrance raw material alcohol selected from the group consisting of undecylenic alcohol, osyrol; sandalore; dihydro carveol; dihydro linalool; dihydromyrcenol; dibydro terpineol; dimetol; alpha-terpineol; tetrahydro linalool; tetrahydro mogol; tetrahydromyrcenol; amyl cinnamic alcohol; 9-decenol: trans-2-hexenol; patchomint; prenol; cuminyl alcohol; para-tolyl alcohol; phenyl ethyl carbinol; ethyl vanillin; isoamyl salicylate; para-hydroxyphenyl butanone; phenethyl salicylate; ethyl linalool; nerolidol; beta gamma hexenol; decyl alcohol; dihydro floralol; hawthanol; heptyl alcohol; isocyclo geraniol; isononyl geraniol; mayol; methyl lavender ketone; octyl alcohol; phenyl propyl alcohol; rhodinol 70; rosalva; camelkol dh; cyclohexyl propyl alcohol; isobutyl benzyl alcohol: lavinol; phenyl ethyl methyl carbinol; propyl benzyl carbinol; iso pulegol; menthol, patchone; rootanol; roselea; trans decahydro beta naphthol; verdol; cinnamic alcohol; farnesol; geraniol; nerol; anisic alcohol; benzyl alcohol; undecavertol; eugenol; isoeugenol; and vanillin.

4. A composition according to claim 1 wherein the acetal is formed from a fragrance raw material aldehyde selected from the group consisting of adoxal; chrysanthal; cyclamal; cymal; trans4-decenal: ethyl vanillin; helional; hydrotrope aldehyde; hydroxycitonellal; isocyclocitral; melonal; methyl nonyl aldehyde; methyl octyl aldehyde; octyl aldehyde; phenyl propanal; citronellal; dodecyl aldehyde; hexylcinnamic aldehyde; myrac aldehyde; vanillin; anisic aldehyde; citral; decyl aldehyde; floralozone; p.t.-bucinal; and triplal.

5. A composition according to claim 1 wherein the acetal or ketal releases a mixture of fragrance raw material alcohols.

6. A composition according to claim 1 wherein said acetal comprises one or more acetals selected from the group consisting of di-(9-decen-1-yl) p-t-bucinal acetal; p-t-bucinal acetal blend made from a mixture of β-γ-hexenol, 9-denen-1-ol and phenoxanol; triplal acetal blend made from a mixture of β-γ-hexenol, 9-decen-1-ol and phenoxanol; di-(β-γ-hexenyl) p-t-bucinal acetal; di-(β-citronellyl) acetal blend of p-t-bucinal, citral, α-hexylcinnamic aldehyde and decanal; and didoceyl floralozone acetal.

7. A composition according to claim 1 wherein component (b) comprises one or more ingredients selected from the group consisting of: cationic fabric softening agents; nonionic fabric softening agents; liquid carrier; concentration aid; soil release agent; perfume; and preservatives/stabilizers.

8. A composition according to claim 7 wherein component (b) comprises from about 1% to about 80% of cationic fabric softening agent.

9. A composition according to claim 8 wherein component (b) comprises:

i) from about 5% to about 50% of a cationic fabric softening agent;

ii) at least about 50% of a liquid carrier; and iii) optionally, from about 0 to about 15% of concentration aids.

10. The composition of claim 9 wherein said cationic fabric softening agent is a biodegradable quaternary ammonium compound having the formula:

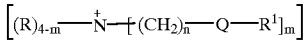

wherein Q has the formula:

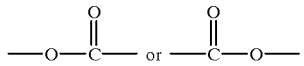

R is $C_1$–$C_6$ alkyl, $C_1$–$C_6$ hydroxyalkyl, benzyl, and mixtures thereof; each $R^1$ is independently linear or branched $C_{11}$–$C_{22}$ alkyl, linear or branched $C_{11}$–$C_{22}$ alkenyl, and mixtures thereof;

X is any softener compatible anion; m is 2 or 3; n is 1 to 4.

11. Rinse added fabric softening compositions comprising:

a) from 0.01% to 15% of an acetal or ketal having the formula:

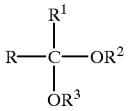

wherein R is $C_3$–$C_{20}$ linear alkyl, $C_4$–$C_{20}$ branched alkyl, $C_6$–$C_{20}$ cyclic alkyl, $C_6$–$C_{20}$ branched cyclic alkyl, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ substituted or unsubstituted aryl, and mixtures thereof; $R^1$ is hydrogen or R; $R^2$ and $R^3$ are each independently selected from the group consisting of $C_5$–$C_{20}$ linear alkyl, $C_4$–$C_{20}$ branched alkyl, $C_6$–$C_{20}$ cyclic alkyl, $C_6$–$C_{20}$ branched cyclic alkyl, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ aryl, $C_7$–$C_{20}$ substituted aryl, and mixtures thereof; provided each acetal or ketal:

i) is formed from at least one fragrance raw material having a molecular weight greater than or equal to about 100 g/mol;

ii) has a molecular weight greater than or equal to about 300 g/mol;

iii) has a molecular weight at least two times greater than the lowest molecular weight fragrance raw material which comprises said acetal or ketal; and b) from 85% to 99.99%. by weight of the composition:

i) from about 5% to about 50% of a cationic fabric softening agent;

ii) from about 50% of a liquid carrier;

iii) optionally, from about 0 to about 15% of concentration aids;

provided said compositions have a neat pH of from about 2 to about 4.5 at 20° C.

12. A composition according to claim 11 wherein said acetal is selected from the group consisting of: di(9-decen-1-yl) p-t-bucinal acetal; p-t-bucinal acetal blend made from a mixture of β-γ-hexenol, 9-decen-1-ol and phenoxanol; triplal acetal blend made from a mixture of β-γ-hexenol, 9-decen-1-ol and phenoxanol; di(β-γ-hexenyl) p-t-bucinal acetal; di(β-citronellyl) acetal blend of p-t-bucinal, citral, α-hexycinnamic aldehyde and decanal; and didodecyl floralozone acetal; and wherein said cationic fabric softening agent is a biodegradable quaternary ammonium compound having the formula:

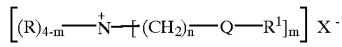

wherein Q has the formula:

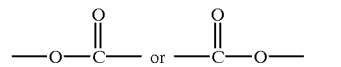

R is $C_1$–$C_6$ alkyl, $C_1$–$C_6$ hydroxyalkyl, benzyl, and mixtures thereof; each $R^1$ is independently linear or branched $C_{11}$–$C_{22}$ alkyl, linear or branched $C_{11}$–$C_{22}$ alkenyl, and mixtures thereof;

X is any softener compatible anion; m is 2 or 3; n is 1 to 4.

13. A process for treating textiles in a rinse cycle of a washing machine comprising the step of contacting textiles in a washing machine with a fabric softening effective amount of a rinse added fabric softening composition comprising:

a) from 0.01% to 15% of an acetal or ketal having the formula:

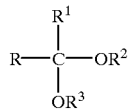

wherein R is $C_3$–$C_{20}$ linear alkyl, $C_4$–$C_{20}$ branched alkyl, $C_6$–$C_{20}$ cyclic alkyl, $C_6$–$C_{20}$ branched cyclic alkyl, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ substituted or unsubstituted aryl, and mixtures thereof; $R^1$ is hydrogen or R; $R^2$ and $R^3$ are each independently selected from the group consisting of $C_5$–$C_{20}$ linear alkyl, $C_4$–$C_{20}$ branched alkyl, $C_6$–$C_{20}$ cyclic alkyl, $C_6$–$C_{20}$ branched cyclic alkyl, $C_6$–$C_{20}$ linear alkenyl, $C_6$–$C_{20}$ branched alkenyl, $C_6$–$C_{20}$ cyclic alkenyl, $C_6$–$C_{20}$ branched cyclic alkenyl, $C_6$–$C_{20}$ aryl, $C_7$–$C_{20}$ substituted aryl, and mixtures thereof, provided each acetal or ketal:

i) is formed from at least one fragrance raw material having a molecular weight greaser than or equal to about 100 g/mol;

ii) has a molecular weight greater than or equal to about 300 g/mol;

iii) has a molecular weight at least two times greater than the lowest molecular weight fragrance raw material which comprises said acetal or ketal; and b) from 85% to 99.99%, by weight of the composition, of adjunct ingredients, said adjunct ingredients selected from the group consisting of fabric softening actives, liquid carriers, concentration aids, soil release agents, perfumes, preservatives, stabilizers, chelants, bacteriocides, colorants, optical brighteners, antifoam agents, and mixtures thereof;

wherein said compositions have a neat pH of less than 6 at 20° C.

* * * * *